US009660399B2

(12) United States Patent
Hsu et al.

(10) Patent No.: US 9,660,399 B2
(45) Date of Patent: May 23, 2017

(54) ELECTRICAL CONNECTOR WITH TWO INSERTION ORIENTATIONS

(71) Applicant: CHIEF LAND ELECTRONIC CO., LTD., New Taipei (TW)

(72) Inventors: Hsin-Hung Hsu, New Taipei (TW); Chien-Chen Lin, Taipei County (TW); Chung-Nan Pao, New Taipei (TW)

(73) Assignee: CHIEF LAND ELECTRONIC CO., LTD., New Taipei (TW)

( * ) Notice: Subject to any disclaimer, the term of this patent is extended or adjusted under 35 U.S.C. 154(b) by 0 days.

(21) Appl. No.: 15/041,417

(22) Filed: Feb. 11, 2016

(65) Prior Publication Data

US 2017/0070013 A1 Mar. 9, 2017

(30) Foreign Application Priority Data

Sep. 9, 2015 (TW) ..... 104129825 A

(51) Int. Cl.

| | |
|---|---|
| ***H01R 9/03*** | (2006.01) |
| ***H01R 24/60*** | (2011.01) |
| ***H01R 13/6585*** | (2011.01) |
| ***H01R 13/6594*** | (2011.01) |

(52) U.S. Cl.

CPC ..... *H01R 24/60* (2013.01); *H01R 13/6585* (2013.01); *H01R 13/6594* (2013.01)

(58) Field of Classification Search

CPC H01R 13/6581; H01R 13/6585; H01R 24/60; H01R 13/6587; H01R 13/6592; H01R 13/6593

USPC ..... 439/607.55, 607.4, 607.41, 660

See application file for complete search history.

(56) References Cited

U.S. PATENT DOCUMENTS

| | | | | |
|---|---|---|---|---|
| 9,281,642 | B1 * | 3/2016 | Tseng | H01R 24/60 |
| 9,281,643 | B1 * | 3/2016 | Tseng | H01R 13/518 |
| 9,350,121 | B2 * | 5/2016 | Ju | H01R 13/6585 |
| 9,379,494 | B1 * | 6/2016 | Hu | H01R 13/6594 |
| 2015/0244110 | A1 * | 8/2015 | Ju | H01R 13/6585 439/607.01 |
| 2015/0244111 | A1 * | 8/2015 | Ju | H01R 13/6585 439/607.05 |
| 2016/0020560 | A1 * | 1/2016 | Ju | H01R 24/78 439/607.05 |

(Continued)

*Primary Examiner* — Hae Hyeon

(74) *Attorney, Agent, or Firm* — Li & Cai Intellectual Property (USA) Office

(57) ABSTRACT

An electrical connector comprises an insulating housing, several first and second conductive terminals, an inner grounding unit, and an outer grounding unit, which are disposed on the insulating housing. The insulating housing has a first surface, an opposite second surface, and two side surfaces arranged between the first and second surfaces. The inner grounding unit has a plate embedded in the insulating housing and two protruding sheets extended from the plate and respectively protruding from the side surfaces of the insulating housing. The plate is arranged to separate the first conductive terminals from the second conductive terminals. The outer grounding unit clips the insulating housing and engages the protruding sheets. A portion of the outer grounding unit engaged with one of the protruding sheets includes two stacked engaging portions, and at least one of the two stacked engaging portions has a thru-hole for engaging with the corresponding protruding sheet.

16 Claims, 22 Drawing Sheets

(56) References Cited

U.S. PATENT DOCUMENTS

| | | | | |
|---|---|---|---|---|
| 2016/0020568 | A1* | 1/2016 | Ju | H01R 24/78<br>439/607.01 |
| 2016/0020572 | A1* | 1/2016 | Ju | H01R 24/78<br>264/272.14 |

* cited by examiner

ELECTRICAL CONNECTOR WITH TWO INSERTION ORIENTATIONS

BACKGROUND OF THE INVENTION

1. Field of the Invention

The instant invention relates to an electrical connector; in particular, to an in either of two insertion orientations electrical connector for coupling with a mating connector.

2. Description of Related Art

With the development of the computer and peripheral device industry, the universal serial bus (USB) has become an important interface for communication and data transmission between computers and peripheral devices. The demand for high-speed transmission of electronic devices has driven electrical connector manufacturers to develop connectors of the capability of high-speed transmission. When an electrical connector operates at the high-speed transmission, unavoidably an electrical interference and a magnetic interference may easily occur between an electrical connector and a mating connector during signals transmitted under such a high frequency. Consequently, the proposed high-speed or high frequency transmission characteristics of an electrical connector may be influenced, and an electronic device (e.g., cell phone, notebook PC, tablet PC, desktop PC, or digital TV) coupled with the electrical connector may also be influenced by aforesaid interferences.

Thus, it is a challenging matter in the electrical connector field to provide a shielding construction within an electrical connector with better interferences immunity and alleviating an electrical and a magnetic interference problem generated during the high-speed transmission.

SUMMARY OF THE INVENTION

The instant disclosure provides an electrical connector for effectively solving the interference problems generated during high-speed transmissions.

The instant disclosure provides an electrical connector, comprising: an insulating housing having a base portion and a tongue plate extended from the base portion; a plurality of first conductive terminals and a plurality of second conductive terminals disposed in the insulating housing, wherein each first conductive terminal faces toward part of one of the second conductive terminals in a height direction; an inner grounding unit having a plate embedded in the insulating housing and two protruding sheets respectively extended from two opposite edges of the plate and protruding from the insulating housing, wherein in the height direction, the plate is arranged to separate each first conductive terminal from the faced part of the second conductive terminal; and an outer grounding unit fastening part of the tongue plate adjacent to the base portion and engaged with the two protruding sheets, wherein part of the outer grounding unit engaged with one of the two protruding sheets has two stacked engaging portions, and at least one of the two stacked engaging portions has a thru-hole to detachably couple with the corresponding protruding sheet.

In summary, the electrical connector of the instant disclosure is provided for loading larger insertion force by engaging the outer grounding unit with the inner grounding unit, and the outer grounding unit is electrically connected to the inner grounding unit for increasing the high frequency effect of the electrical connector.

In order to further appreciate the characteristics and technical contents of the instant invention, references are hereunder made to the detailed descriptions and appended drawings in connection with the instant invention. However, the appended drawings are merely shown for exemplary purposes, rather than being used to restrict the scope of the instant invention.

DETAILED DESCRIPTION OF THE PREFERRED EMBODIMENTS

[First Embodiment]

Please refer to FIGS. 1 through 11, which show an embodiment of the instant disclosure. References are hereunder made to the detailed descriptions and appended drawings in connection with the instant invention. However, the appended drawings are merely shown for exemplary purposes, rather than being used to restrict the scope of the instant invention.

Figure 1A:
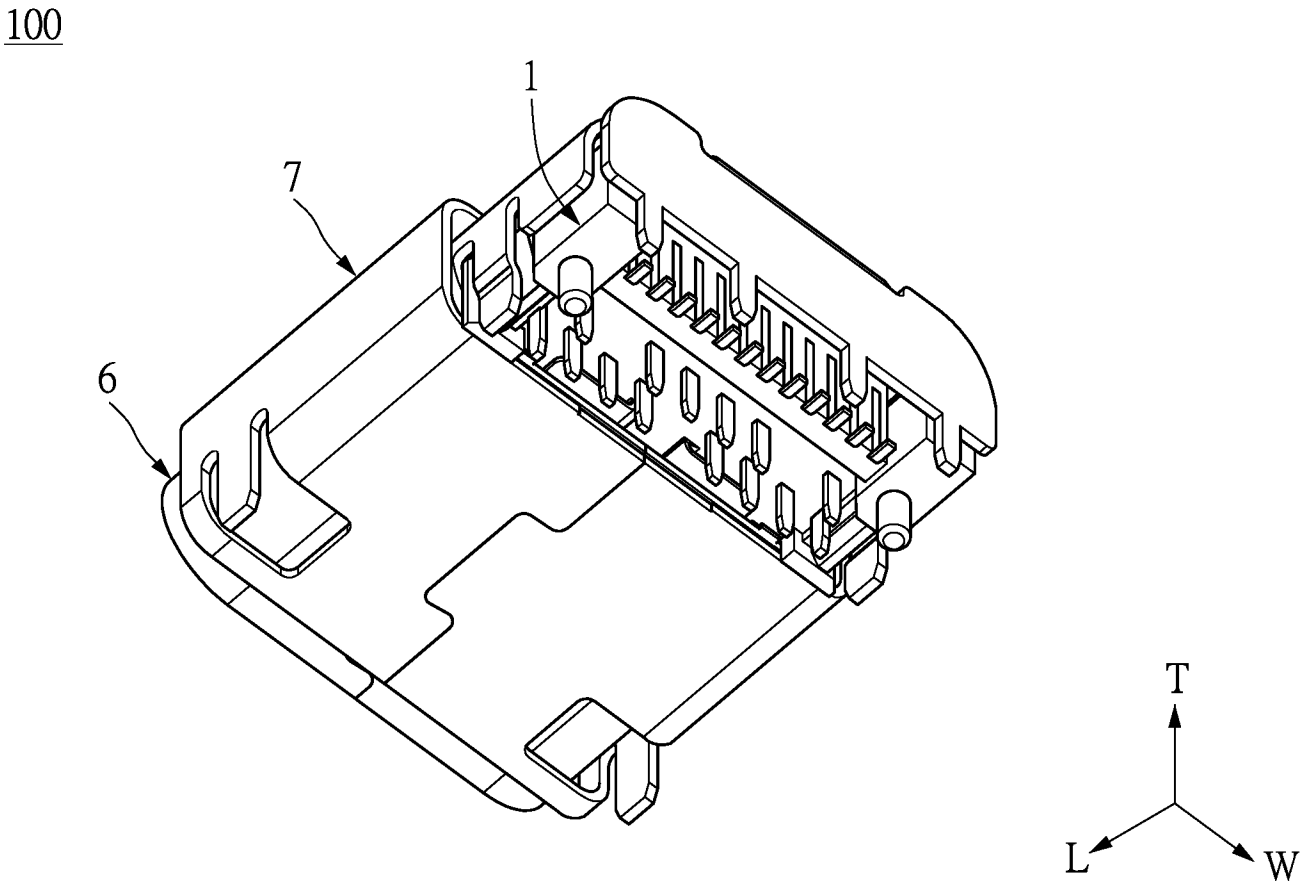
FIG. 1A is a perspective view showing an electrical connector according to a first embodiment of the instant disclosure.
Figure 2A:
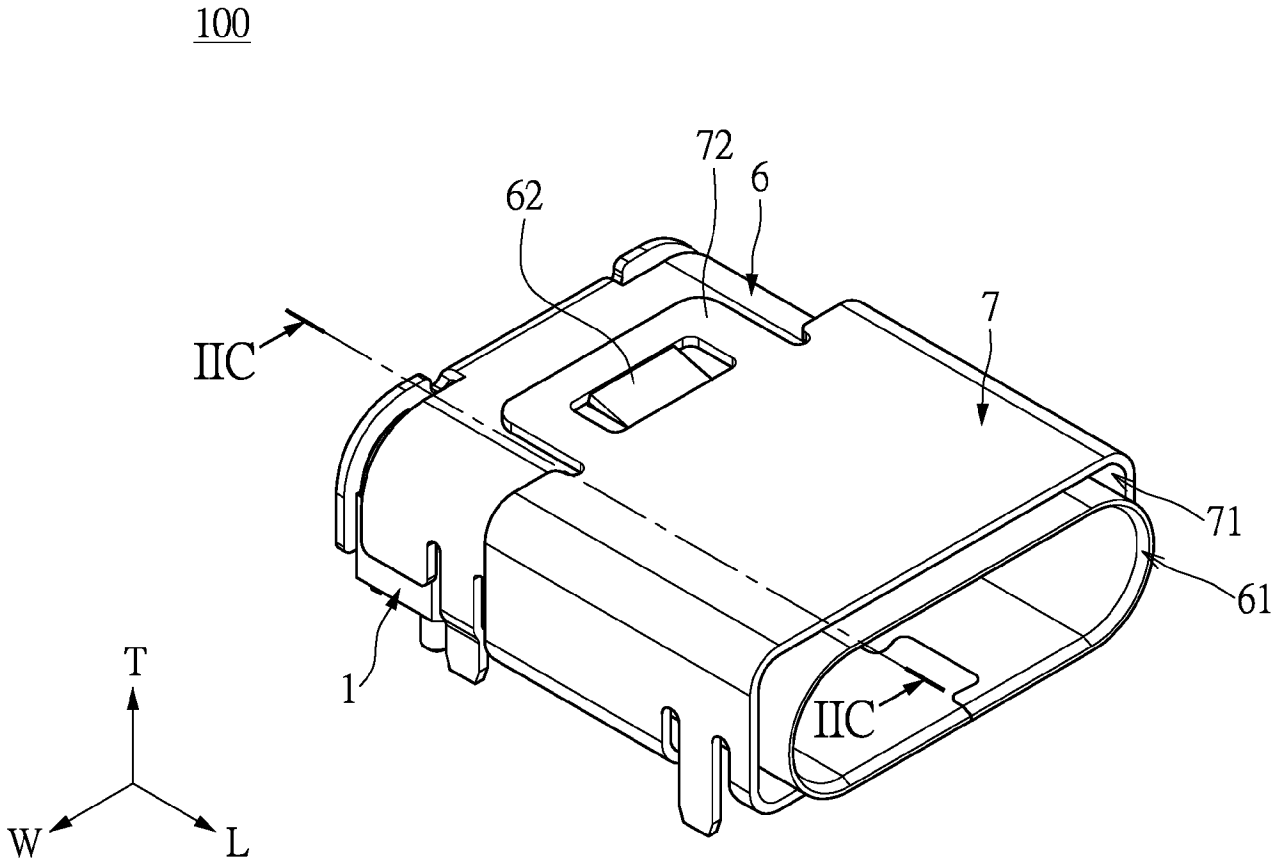
FIG. 2A is a perspective view of FIG. 1A from another perspective.

As shown in FIGS. 1A and 2A, the instant embodiment provides an electrical connector 100 for soldering on a circuit board (not shown) and inserting into a mating connector (not shown) in either of two insertion orientations. The electrical connector 100 can be mounted on the circuit board, or the electrical connector 100 (such as a sinking connector) can be arranged in a notch of the circuit board. Each terminal of the electrical connector 100 can be a straight construction or a right angle construction, but the instant embodiment is not limited thereto. The electrical connector 100 of the instant embodiment is a USB socket electrical connector for example.

Figure 1B:
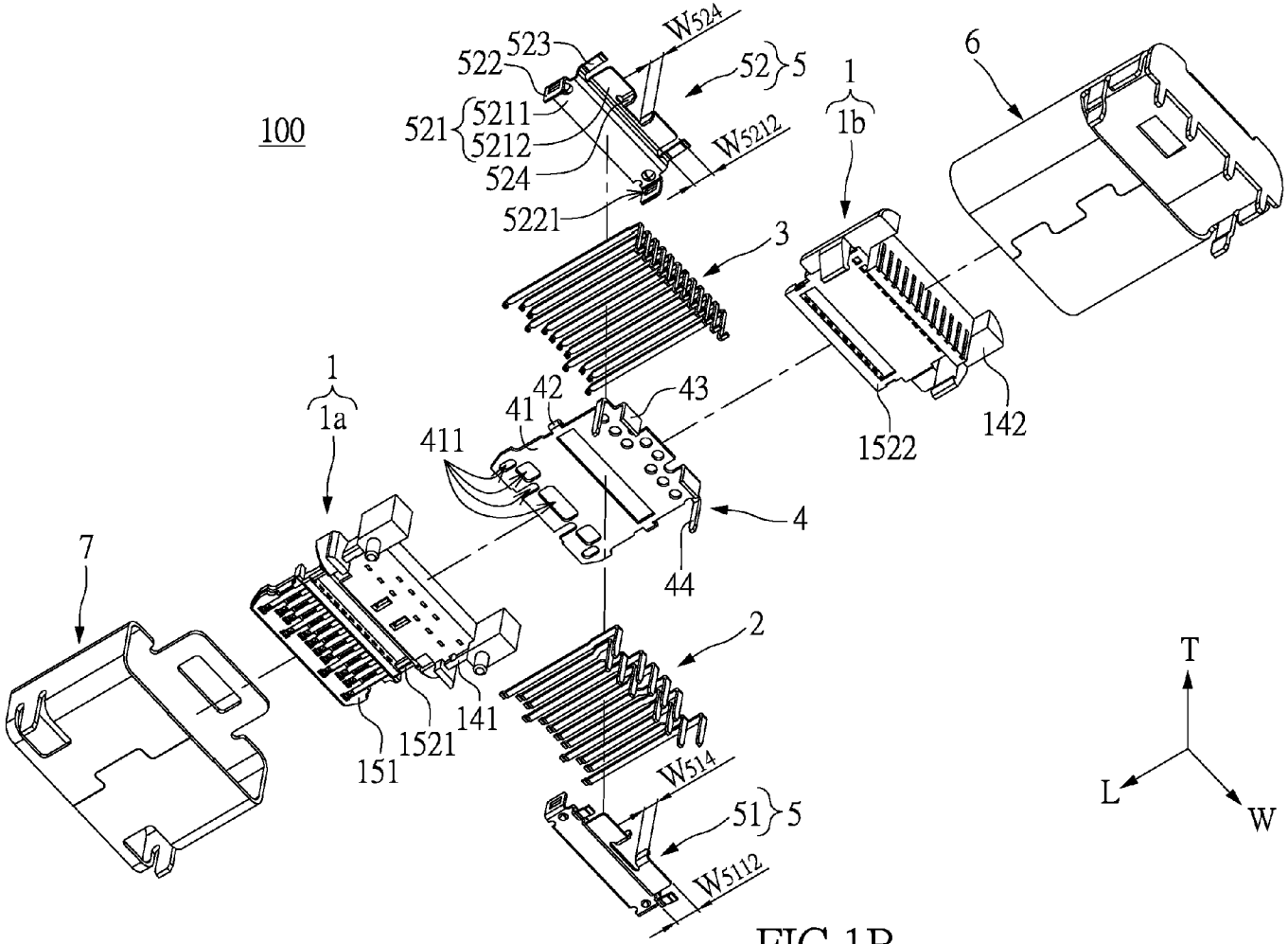
FIG. 1B is an exploded view of FIG. 1A.
Figure 2B:
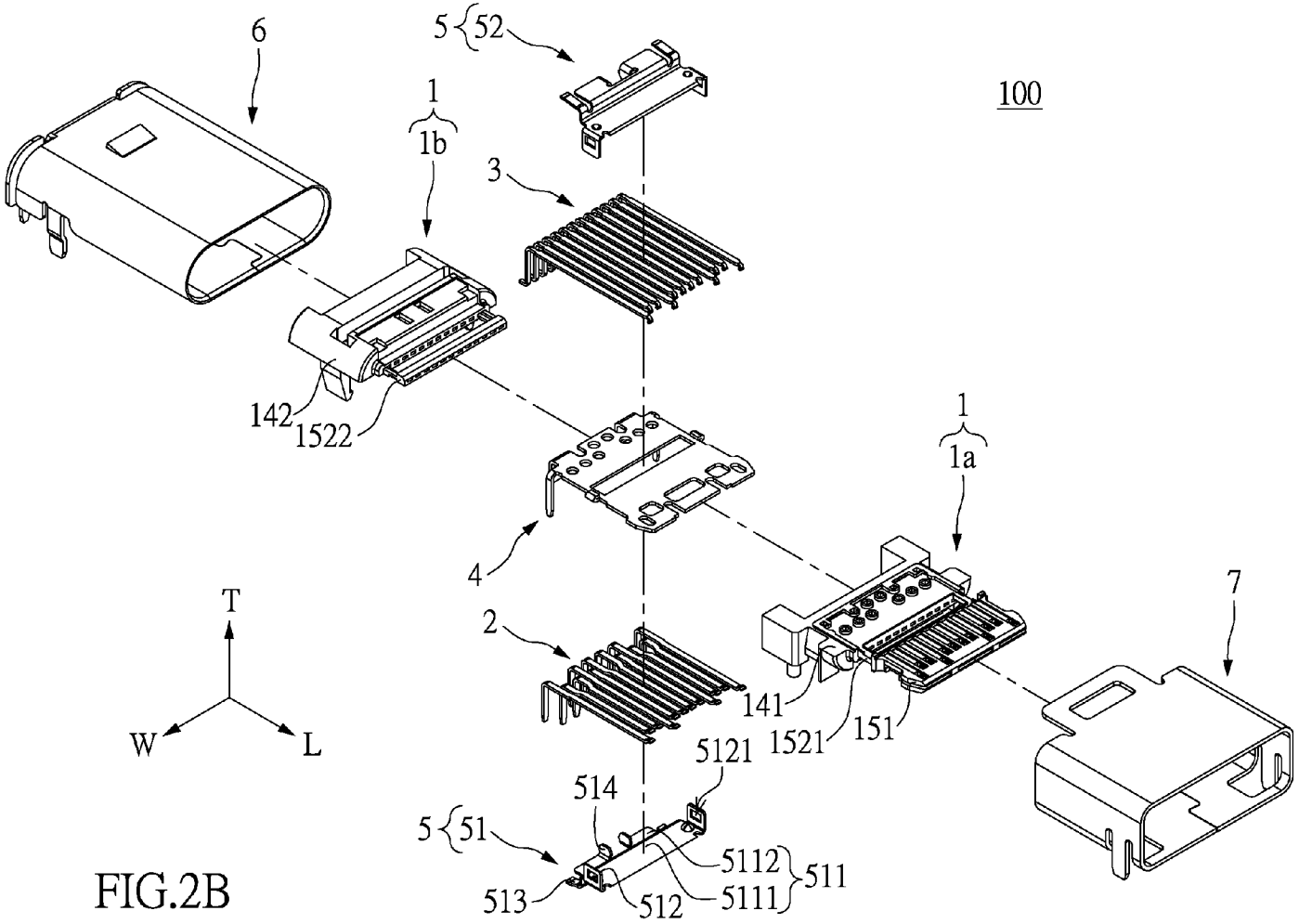
FIG. 2B is an exploded view of FIG. 2A.

As shown in FIGS. 1B and 2B, the electrical connector 100 includes an insulating housing 1, a plurality of first conductive terminals 2 disposed in the insulating housing 1, a plurality of second conductive terminals 3 disposed in the insulating housing 1, an inner grounding unit 4 partially embedded in the insulating housing 1, an outer grounding unit 5 covering the insulating housing 1, a first metallic shell 6 sleeved at the insulating housing 1, and a second metallic shell 7 sleeved at the first metallic shell 6. The following description discloses the construction of each component of the electrical connector 100 and the relationship of the above components of the electrical connector 100.

Figure 3:
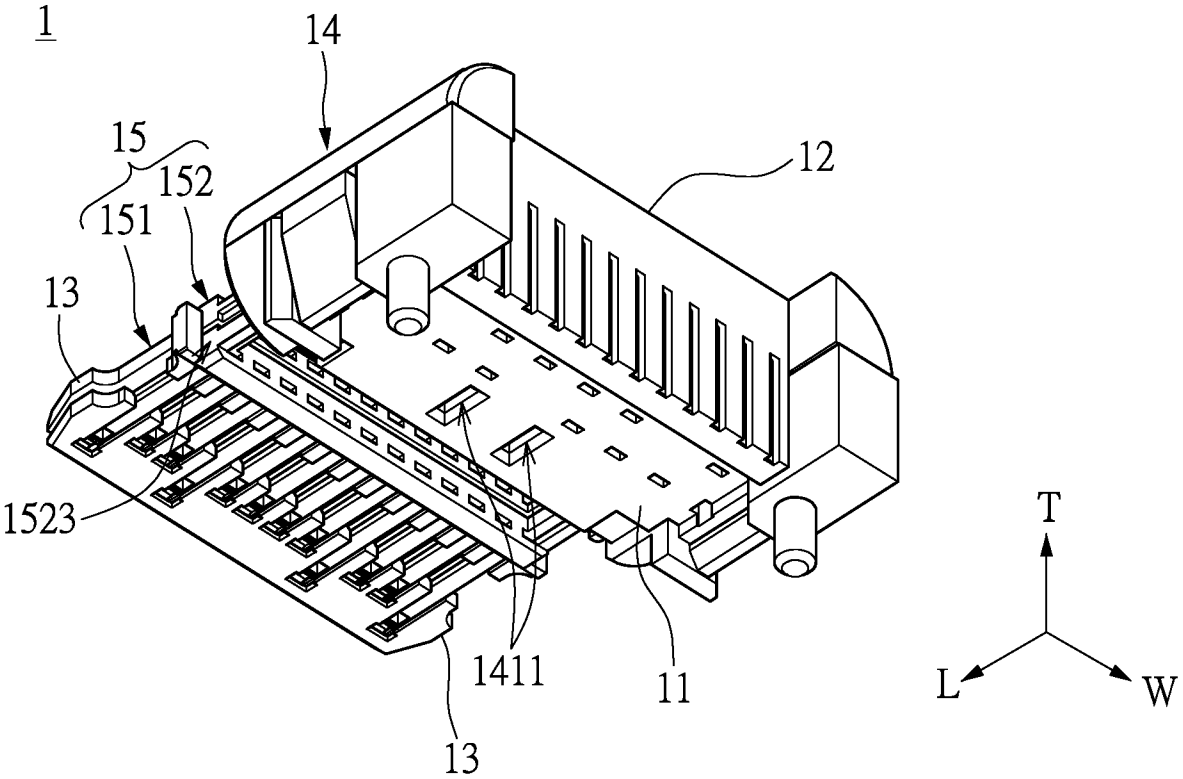
FIG. 3 is a perspective view showing an insulating housing of the electrical connector according to the instant disclosure.
Figure 4:
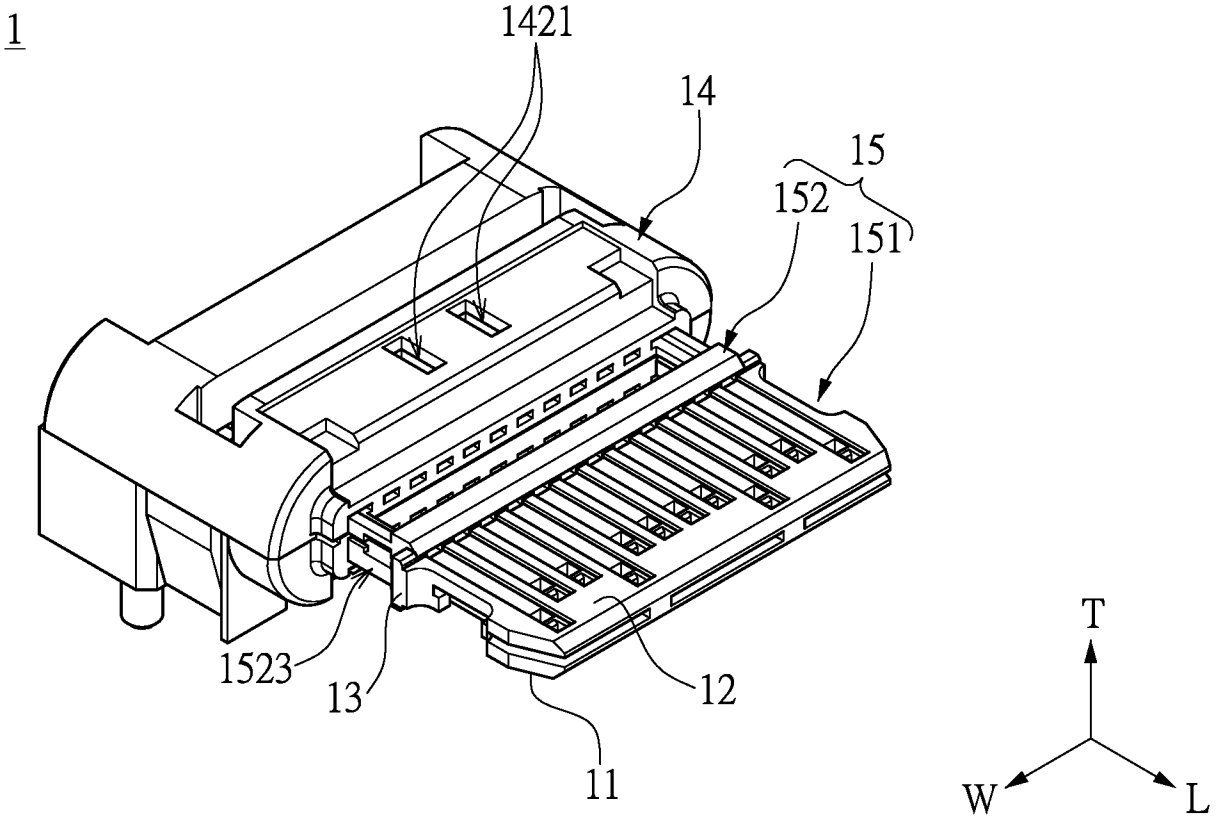
FIG. 4 is a perspective view of FIG. 3 from another perspective.

As shown in FIGS. 3 and 4, for clear explanation, when the insulating housing 1 is regarded as one piece, the outer surface of the insulating housing 1 includes a first surface 11 (i.e., the bottom surface of the insulating housing 1 as shown in FIG. 3), a second surface 12 (i.e., the top surface of the insulating housing 1 as shown in FIG. 3) opposing to the first surface 11, and two side surfaces 13 (i.e., the left and right side surfaces of the insulating housing 1 as shown in FIG. 3) arranged between the first and second surfaces 11, 12. The insulating housing 1 defines a height direction T, a width direction W, and a longitudinal direction L, which are perpendicular with each other. The height direction T parallels a distance between the first and second surfaces 11, 12. The width direction W parallels a distance between the two side surfaces 13. The longitudinal direction L parallels an inserting direction of the electrical connector 100. That is to say, the first and second surfaces 11, 12 of the insulating housing 1 in the instant embodiment are respectively two portions of the outer surface of the insulating housing 1 perpendicular to the height direction T.

Moreover, the insulating housing 1 has a base portion 14 and a tongue plate 15 integrally extended from the base portion 14 along the longitudinal direction L. The tongue plate 15 has a front segment 151 arranged away from the base portion 14 and a rear segment 152 arranged adjacent to the base portion 14. A thickness of the base portion 14 in the height direction T is greater than that of the rear segment 152 of the tongue plate 15, and the thickness of the rear segment 152 of the tongue plate 15 in the height direction T is greater than that of the front segment 151.

The base portion 14 has two first slots 1411 concavely formed on the first surface 11 thereof along the height direction T and two second slots 1421 concavely formed on the second surface 12 thereof along the height direction T. The shape of the cross-section of each of the first and second slots 1411, 1421 perpendicular to the height direction T is substantially a rectangle, and the length direction of each said rectangle approximately parallels to the longitudinal direction L. The rear segment 152 of the tongue plate 15 has two accommodating slots 1523 respectively concavely formed on the two side surfaces 13 thereof.

The features of the insulating housing 1 regarded as one piece have been disclosed in the above description, and the insulating housing 1 in the instant embodiment is actually provided with two pieces as shown in FIGS. 1B and 2B. Specifically, the insulating housing 1 consists of a first body 1*a* and a second body 1*b* engaged with the first body 1*a*. The first body 1*a* includes a first base portion 141, a first rear segment 1521, and the front segment 151 of the tongue plate 15. The second body 1*b* includes a second base portion 142 and a second rear segment 1522. The first base portion 141 and the second base portion 142 are reassembled to be the base portion 14, and the first rear segment 1521 and the second rear segment 1522 are reassembled to be the rear segment 152. The insulating housing 1 in the instant embodiment is provided with the two pieces for example, but the insulating housing 1 of the instant disclosure can be formed integrally.

In order to clearly realize the instant embodiment, the following description mainly takes the insulating housing 1 to be regarded as one piece, and then suitably discloses the related features of the first and second bodies 1*a*, 1*b* and the other components.

Figure 5A:
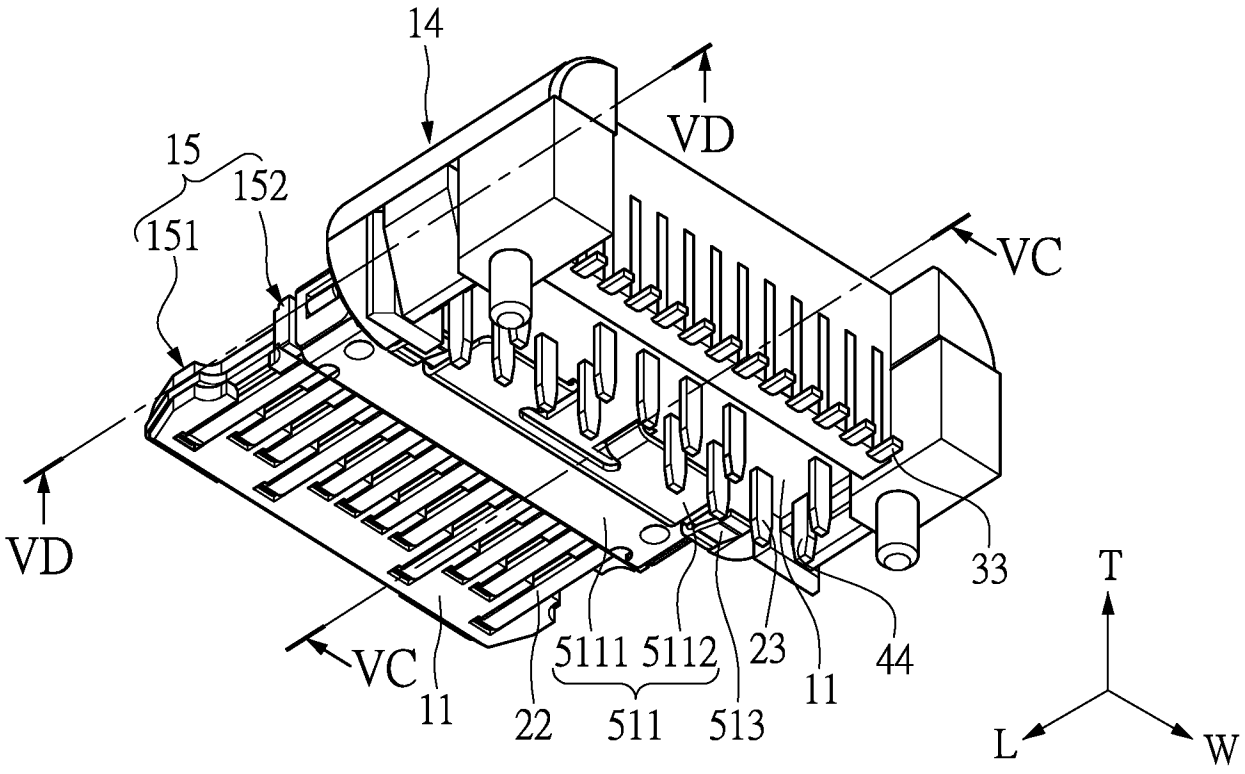
FIG. 5A is a perspective view of FIG. 1A without showing the first and second metallic shells.
Figure 5B:
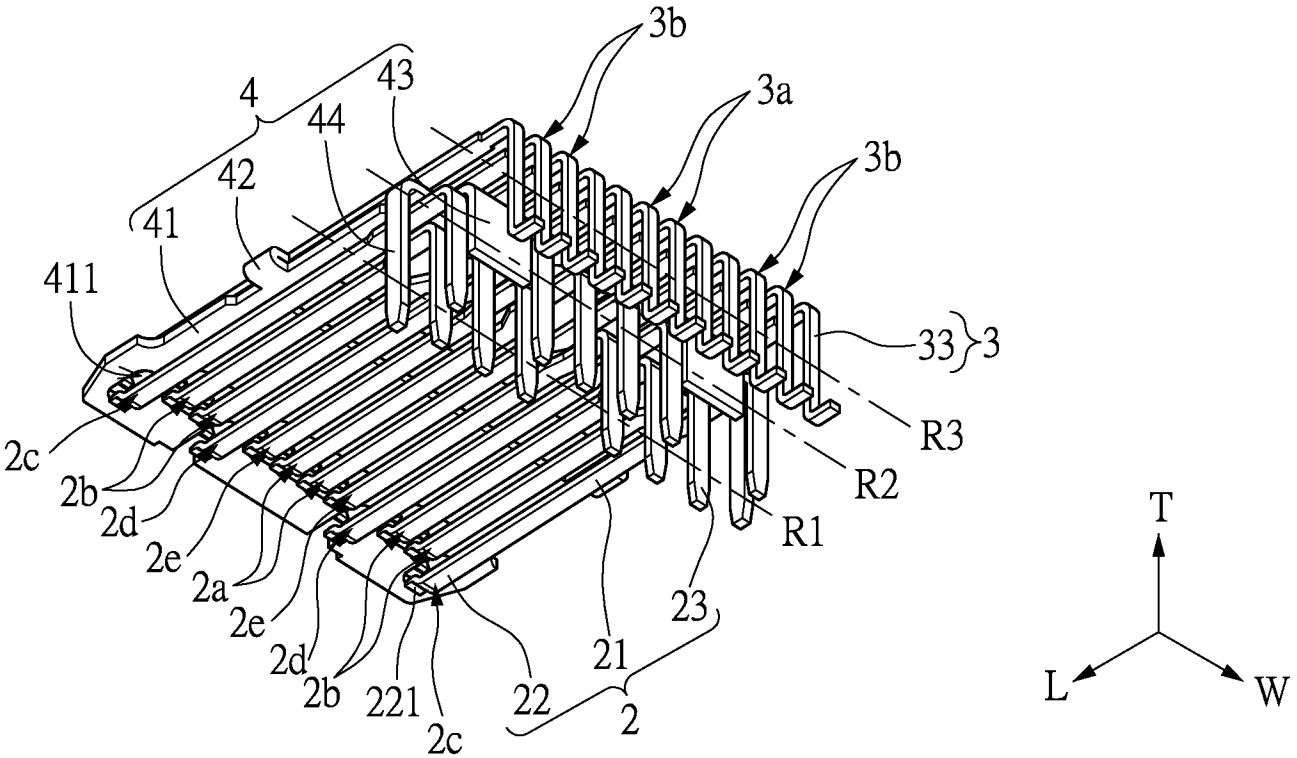
FIG. 5B is a perspective view showing the first and second conductive terminals and the inner grounding unit of FIG. 5A.

As shown in FIGS. 5A and 5B, each first conductive terminal 2 has a first extending segment 21, a first engaging segment 22 extended from one end of the first extending segment 21 along the longitudinal direction L, and a first connecting segment 23 perpendicularly extended from the other end of the first extending segment 21. Each first engaging segment 22 has a first free end portion 221 arranged away from the first extending segment 21, and each first free end portion 221 is curved with respect to the other portion of the corresponding first engaging segment 22.

Figure 5C:
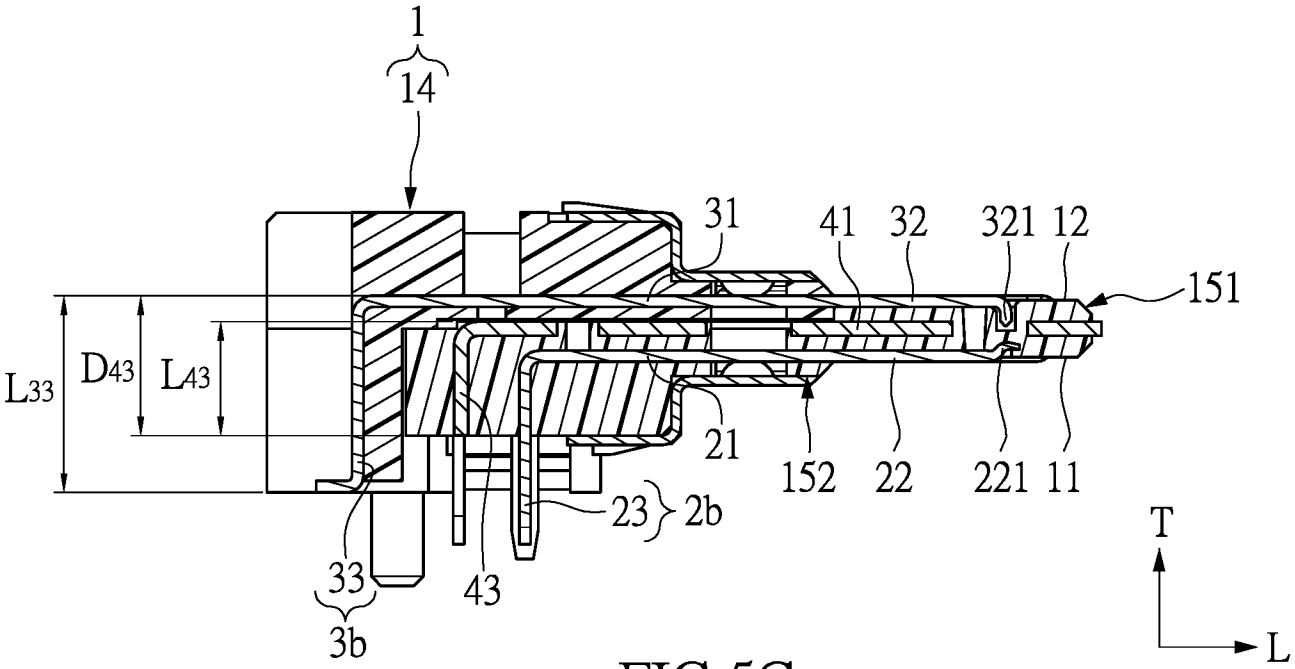
FIG. 5C is a cross-sectional view of FIG. 5A along a cross-sectional line VC-VC.

Moreover, the first engaging segments 22 are arranged on the first surface 11 of the front segment 151 of the tongue plate 15 and are arranged in one row along the width direction W. The first free end portion 221 of each first engaging segment 22 is received in the front segment 151, and the other portion of each first engaging segment 22 is protruded from the first surface 11 of the front segment 151 with two-thirds of a thickness thereof in the height direction T (as shown in FIG. 5C). The first extending segments 21 are embedded in the rear segment 152 of the tongue plate 15 and the base portion 14 and are arranged in one row along the width direction W. Each first connecting segment 23 is partially protruded from the base portion 14 of the insulating housing 1. The first connecting segments 23 are respectively arranged in a first row R1 along the width direction W and a second row R2 parallel to the first row R1, and the front segment 151 of the tongue plate 15 is closer to the first row R1 than the second row R2.

When the first conductive terminals 2 are defined by their functions, the first conductive terminals 2 include a pair of first inside signal terminals 2*a*, two pairs of first outside signal terminals 2*b*, two first grounding terminals 2*c*, two first power terminals 2*d*, and two first detecting terminals 2*e*. In other words, the arrangement of the first conductive terminals 2 along the width direction W (e.g., from left side to right side as shown in FIG. 5B) are a first grounding terminal 2*c*, a pair of first outside signal terminals 2*b*, a first power terminal 2*d*, a first detecting terminal 2*e*, a pair of first inside signal terminals 2*a*, a first detecting terminal 2*e*, a first power terminal 2*d*, a pair of first outside signal terminals 2*b*, and a first grounding terminal 2*c*.

Specifically, the first connecting segments 23 of the two pairs of first outside signal terminals 2*b* and the two first detecting terminals 2*e* are arranged in the first row R1. The first connecting segments 23 of the pair of first inside signal terminals 2*a*, the two first grounding terminals 2*c*, and the two first power terminals 2*d* are arranged in the second row R2.

Figure 6A:
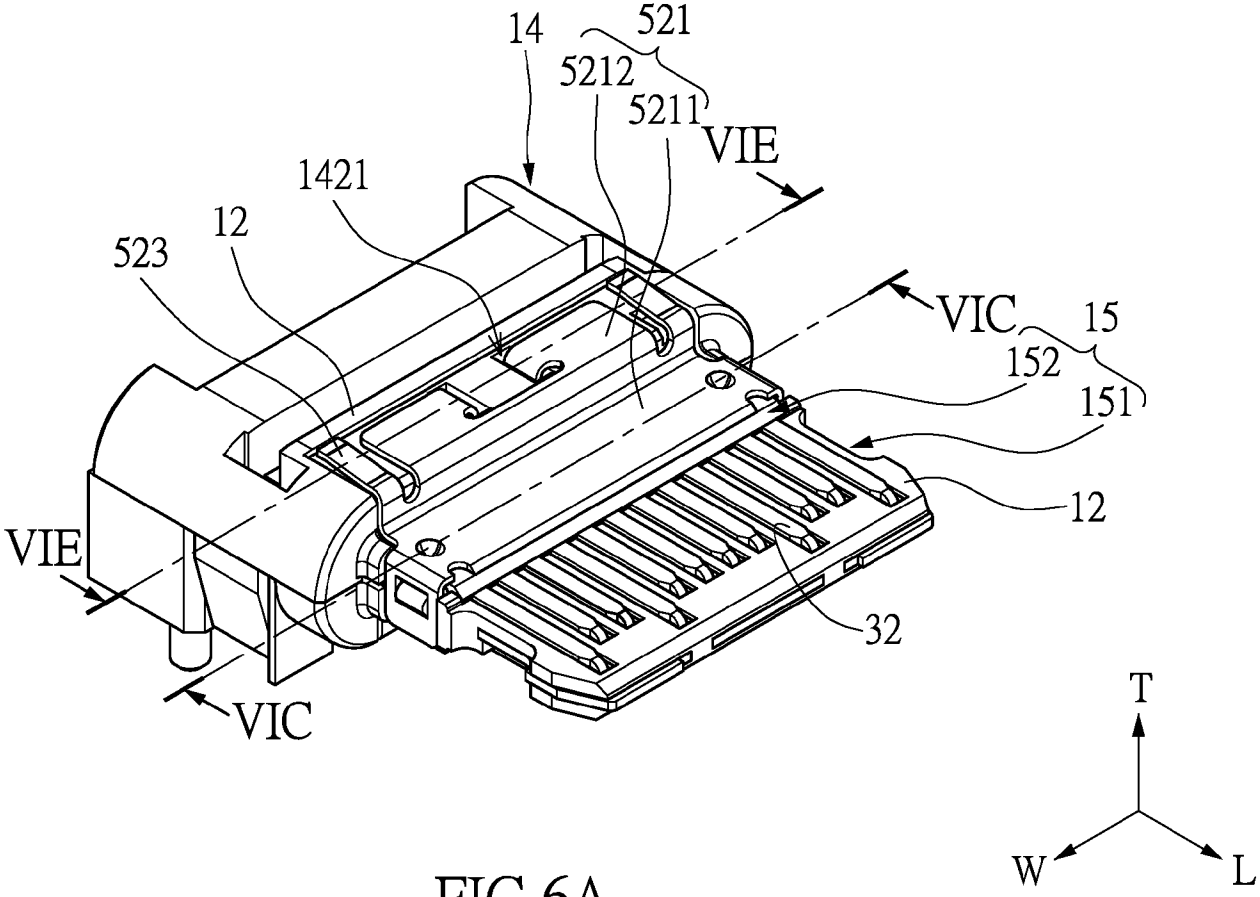
FIG. 6A is a perspective view of FIG. 2A without showing the first and second metallic shells.
Figure 6B:
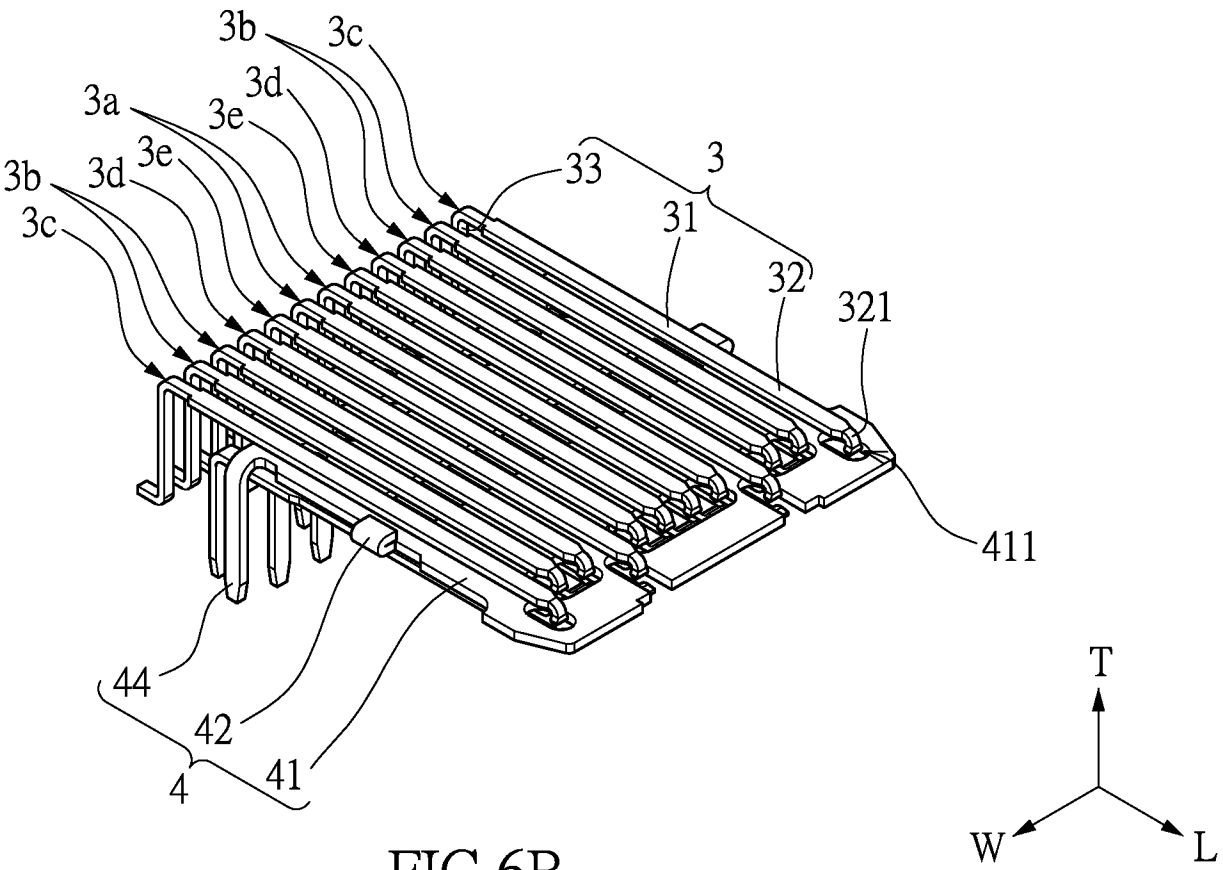
FIG. 6B is a perspective view showing the first and second conductive terminals and the inner grounding unit of FIG. 6A.

As shown in FIGS. 6A and 6B, each second conductive terminal 3 has a second extending segment 31, a second engaging segment 32 extended from one end of the second extending segment 31 along the longitudinal direction L, and a second connecting segment 33 perpendicularly extended from the other end of the second extending segment 31. Each second engaging segment 32 has a second free end portion 321 arranged away from the second extending segment 31, and each second free end portion 321 is curved with respect to the other portion of the corresponding second engaging segment 32 and received in the front segment 151.

Moreover, the second engaging segments 32 are arranged on the second surface 12 of the front segment 151 of the tongue plate 15 and are arranged in one row along the width direction W. The second free end portion 321 of each second engaging segment 32 is in interference fit with the front segment 151 (e.g., the second free end portion 321 is provided with a barb to couple with the front segment 151), and the other portion of each second engaging segment 32 is protruded from the second surface 12 of the front segment 151 with two-thirds of a thickness thereof in the height direction T (as shown in FIG. 5C). The second extending segments 31 are embedded in the rear segment 152 of the tongue plate 15 and the base portion 14 and are arranged in one row along the width direction W. As shown in FIGS. 5A and 5B, each second connecting segment 33 is partially protruded from the base portion 14 of the insulating housing 1. The second connecting segments 33 are arranged in a third row R3 parallel to the first row R1 and the second row R2. The third row R3 is arranged further away from the front segment 151 of the tongue plate 15 than the second row R2, that is to say, the second row R2 is located between the first row R1 and the third row R3.

Specifically, each second engaging segment 32 having the second free end portion 321 perpendicular to the other portion thereof, which is an independent variable in the following simulation, is provided to adjust an impedance of the electrical connector 100, which is a dependent variable in the following simulation. For clearly showing the adjusting effect, a simulation is implemented by taking the electrical connector 100 of the instant embodiment to be a treatment group and taking an electrical connector (not shown), which is provided without any curved free end portion, to be a control group, and the simulation result is shown as FIG. 8. The curve C1 presents the simulation result of the treatment groups, and the curve C2 presents the simulation result of the control groups. Accordingly, the electrical connector 100 of the instant embodiment has an impedance of approximate 85 ohm, which is a generally requested standard of a socket connector, by forming the curved second free end portions 321.

When the second conductive terminals 3 are defined by their functions, the second conductive terminals 3 include a pair of second inside signal terminals 3*a*, two pairs of second outside signal terminals 3*b*, two second grounding terminals 3*c*, two second power terminals 3*d*, and two second detecting terminals 3*e*. In other words, the arrangement of the second conductive terminals 3 along the width direction W (e.g., from left side to right side as shown in FIG. 6B) are a second grounding terminal 3*c*, a pair of second outside signal terminals 3*b*, a second power terminal 3*d*, a second detecting terminal 3*e*, a pair of second inside signal terminals 3*a*, a second detecting terminal 3*e*, a second power terminal 3*d*, a pair of second outside signal terminals 3*b*, and a second grounding terminal 3*c*.

In addition, as shown in FIG. 5C, the first engaging segments 22 respectively face toward the second engaging segments 32 along the height direction T, and the arrangement of the first engaging segments 22 is substantially identical to the arrangement of the second engaging segments 32, so that a mating connector (e.g., a USB plug connector) can insert into the electrical connector 100 of the instant embodiment by using a standard manner or a reverse manner, which is rotating the standard manner by 180 degrees. Moreover, as shown in FIG. 5B, the second connecting segments 33 of the two pairs of second outside signal terminals 3*b* are respectively arranged close to the first connecting segments 23 of the two pairs of first outside signal terminals 2*b*, so a crosstalk problem may occur to the electrical connector 100 when the second connecting segments 33 of each pair of second outside signal terminals 3*b* and the first connecting segments 23 of the adjacent pair of first outside signal terminals 2*b* are used to transmit signals. Thus, a construction of the electrical connector 100 needs to consider a shielding effect, the proposed construction of the electrical connector 100 will be disclosed in the following description.

As shown in FIG. 1B, the inner grounding unit 4 includes a plate 41, two protruding sheets 42 respectively extended from approximately center portions of the two opposite side edges of the plate 41, two longitudinal shielding sheets 43 perpendicularly extended from a rear edge of the plate 41, and two pins 44 respectively and perpendicularly extended from rear portions of the two opposite side edges of the plate 41.

As shown in FIGS. 5B, 5C, and 6B, the plate 41 is embedded in the insulating housing 1 and approximately arranged between the first extending and engaging segments 21, 22 of the first conductive terminals 2 and the second extending and engaging segments 31, 32 of the second conductive terminals 3, such that the first extending and engaging segments 21, 22 of the first conductive terminals 2 are respectively separated from the second extending and engaging segments 31, 32 of the second conductive terminals 3 by the plate 41. A plurality of openings 411 are penetratingly formed on the plate 41 of the inner grounding unit 4, and the openings 411 are respectively arranged between the first free end portions 221 of the first engaging segments 22 and the corresponding second free end portions 321 of the second engaging segments 32. The second free end portions 321 of the second engaging segments 32 are respectively and partially arranged in the openings 411 of the plate 41.

Specifically, the plate 41 is provided with the openings 411, which is an independent variable in the following simulation, thereby adjusting an impedance of the electrical connector 100, which is a dependent variable in the following simulation. For clearly showing the adjusting effect, a simulation is implemented by taking the electrical connector 100 of the instant embodiment to be a treatment group and taking an electrical connector (not shown), which has a plate provided without any opening, to be a control group, and the simulation result is shown as FIG. 9. The curve C3 presents the simulation result of the treatment groups, and the curve C4 presents the simulation result of the control groups. Accordingly, the electrical connector 100 of the instant embodiment has an impedance of approximate 85 ohm, which is a generally requested standard of a socket connector, by forming the openings 411 on the plate 41.

Figure 6C:
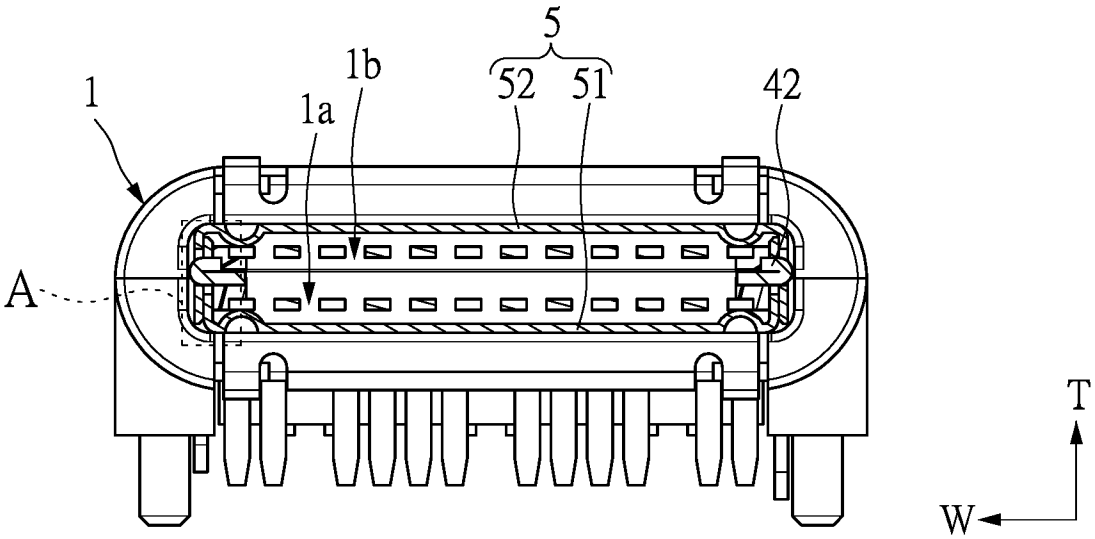
FIG. 6C is a cross-sectional view of FIG. 6A along a cross-sectional line VIC-VIC.
Figure 6D:
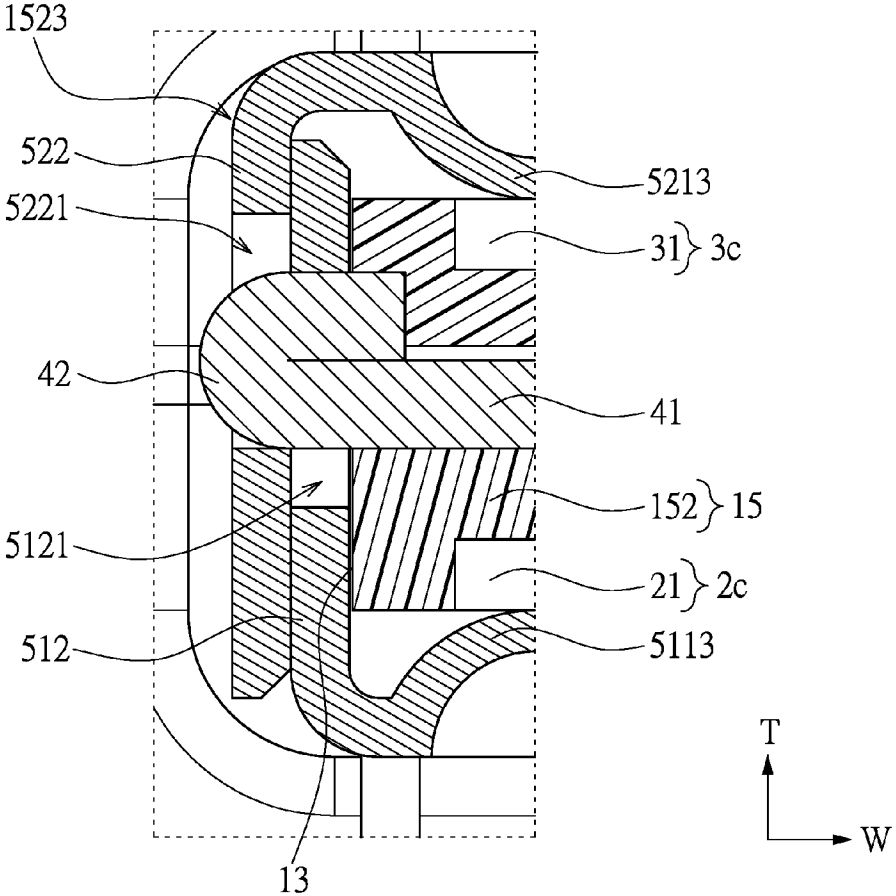
FIG. 6D is an enlarged view showing the portion A of FIG. 6C.

As shown in FIGS. 6C and 6D, the two protruding sheets 42 are respectively extended from the two opposite side edges of the plate 41 and are respectively protruding from the accommodating slots 1523, which are respectively arranged on the two side surfaces 13 of the rear segment 152 of the tongue plate 15. Specifically, each protruding sheet 42 is integrally extended from the plate 41 and bent in 180 degrees, so that an outer surface of each protruding sheet 42 has an arc shape to be capable of a better guiding and engaging performance.

Figure 5D:
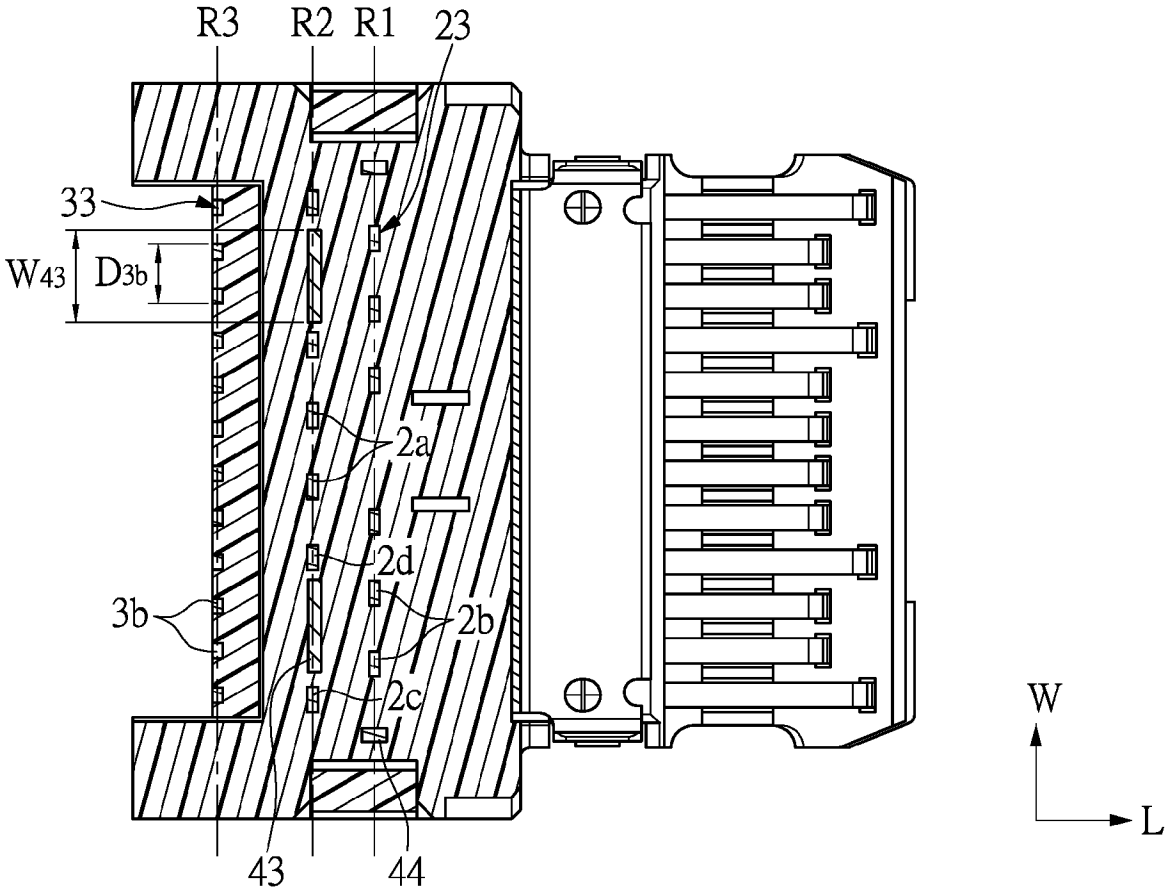
FIG. 5D is a cross-sectional view of FIG. 5A along a cross-sectional line VD-VD.

As shown in FIG. 5D, the two longitudinal shielding sheets 43 are embedded in the insulating housing 1 and are arranged between the first row R1 and the third row R3. The two longitudinal shielding sheets 43 are arranged in the second row R2 and respectively arranged at two opposite outer sides of the first connecting segments 23 of the pair of first inside signal terminals 2*a*. Specifically, in the width direction W, the longitudinal shielding sheet 43 is arranged between the first connecting segments 23 of the first grounding terminal 2*c* and the adjacent first power terminal 2*d*. In the longitudinal direction L, each of the longitudinal shielding sheets 43 is approximately arranged between the second connecting segments 33 of the adjacent pair of second outside signal terminals 3*b* and the first connecting segments 23 of the adjacent pair of first outside signal terminals 2*b*, thus the two longitudinal shielding sheets 43 have an electromagnetic shielding function occurring between each pair of second outside signal terminals 3*b* and the adjacent pair of first outside signal terminals 2*b*, thereby reducing crosstalk of differential signaling.

Specifically, as shown in FIG. 5C, any longitudinal shielding sheet 43 is configured to cover part of the first connecting segments 23 of the corresponding pair of first outside signal terminals 2*b* in the longitudinal direction L, such that the second connecting segments 33 of the pair of second outside signal terminals 3*b* and the first connecting segments 23 of the pair of first outside signal terminals 2*b*, which are arranged at two opposite sides of the corresponding longitudinal shielding sheet 43, are provided an electromagnetic shielding there-between in the longitudinal direction L. In the instant embodiment, a length $L_{43}$ of any longitudinal shielding sheet 43 in the height direction T is approximately 60% of a length $L_{33}$ of each second connecting segment 33 in the height direction T.

In addition, the length of any longitudinal shielding sheet 43 in the height direction T has a limitation, and the limitation is disclosed as follows. In the height direction T, a distance $D_{43}$ between one end of each longitudinal shielding sheet 43 arranged away from the plate 41 (i.e., the bottom end of the longitudinal shielding sheet 43 shown in FIG. 5C) and the adjacent second extending segment 31 is less than or equal to the length $L_{33}$ of each second connecting segment 33. If the electrical connector 100 is mounted on a circuit board (not shown, e.g., the circuit board is arranged on the bottom end of the second connecting segment 33 as shown in FIG. 5C), each longitudinal shielding sheet 43 should avoid contacting with a trace formed on the circuit board, thus a gap of 2~3 mm is preferably provided between the bottom end of each longitudinal shielding sheet 43 and the circuit board. That is to say, the distance $D_{43}$ is preferably less than the length $L_{33}$ by 2~3 mm.

Moreover, as shown in FIG. 5D, in the width direction W, a width $W_{43}$ of each longitudinal shielding sheet 43 in the instant embodiment is greater than or equal to a distance $D_{3b}$ between two opposite outer edges of the second connecting segments 33 of the adjacent pair of second outside signal terminals 3*b*, such that each longitudinal shielding sheet 43 can be provided with a better electromagnetic shielding effect. In a non-shown embodiment, the width $W_{43}$ of each longitudinal shielding sheet 43 can be greater than or equal to a distance between two opposite outer edges of the first connecting segments 23 of the adjacent pair of first outside signal terminals 2*b*, and the instant disclosure is not limited thereto. In summary, the width $W_{43}$ of each longitudinal shielding sheet 43 should be greater than or equal to a smallest distance in the width direction W, and the smallest distance is chosen from the distance $D_{3b}$ between the two opposite outer edges of the second connecting segments 33 of the adjacent pair of second outside signal terminals 3*b* and the distance between the two opposite outer edges of the first connecting segments 23 of the adjacent pair of first outside signal terminals 2*b*.

Accordingly, in order to clearly know the effect generated from the two longitudinal shielding sheets 43, a simulation is implemented by taking the electrical connector 100 of the instant embodiment to be a treatment group and taking an electrical connector (not shown), which is provided without any longitudinal shielding sheet 43, to be a control group. Specifically, the simulation is implemented by inputting a detecting signal into one of the first outside signal terminals 2*b* and measuring the adjacent second outside signal terminal 3*b*, therefore understanding the noise on the adjacent second outside signal terminal 3*b*, arising from the signal transmission of the first outside signal terminals 2*b*.

Figure 10:
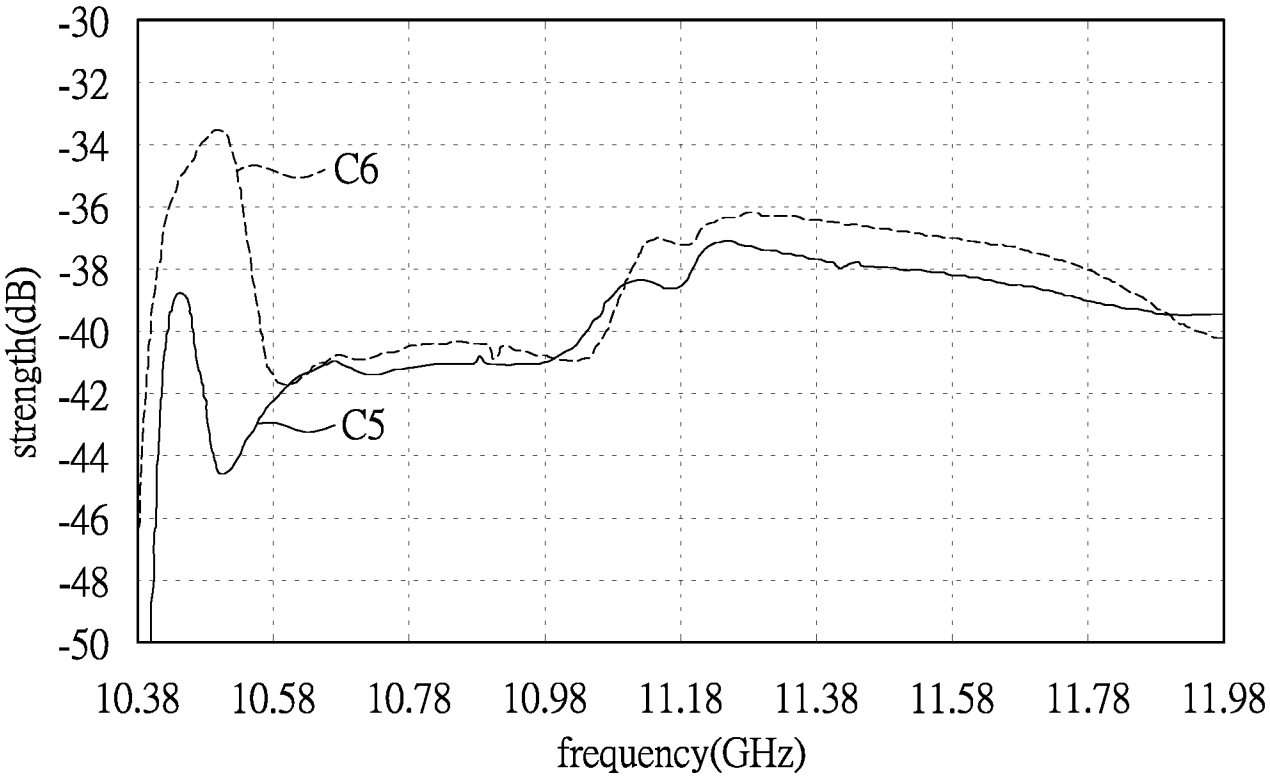
FIG. 10 is a third diagram showing a simulation result, which is generated by taking the electrical connector of the instant disclosure as a treatment group and taking a corresponding connector as a control group.

The simulation result is shown as FIG. 10. The curve C5 presents the simulation result of the treatment groups, and the curve C6 presents the simulation result of the control groups. Accordingly, the electrical connector 100 of the instant embodiment can be used to reduce crosstalk of differential signaling in the longitudinal direction L, by forming the two longitudinal shielding sheets 43.

In addition, the inner grounding unit 4 in the instant embodiment is provided with the two longitudinal shielding sheets 43, but the number of longitudinal shielding sheets 43 of the inner grounding unit 4 is not limited thereto. For example, the inner grounding unit 4 can be provided with only one longitudinal shielding sheet 43.

As shown in FIGS. 5A and 5B, each pin 44 partially protrudes from the first surface 11 of the base portion 14 of the insulating housing 1. The two pins 44 are arranged in the first row R1 and are respectively arranged at two opposite sides of the first connecting segments 23 of the two pairs of first outside signal terminals 2*b*. Specifically, the two pins 44 are respectively arranged at two opposite sides of the first connecting segments 23 of the two first grounding terminals 2*c*. In the height direction T, a length of each pin 44 is approximately equal to a length of each first connecting segment 23. In the longitudinal direction L, a width of each pin 44 is greater than a thickness of each first connecting segment 23. Thus, the two pins 44 are configured to respectively cover two opposite sides of the first connecting segments 23 in the first row R1 (as shown in FIG. 5D).

As shown in FIGS. 2B, 5A, and 6A, the outer grounding unit 5 surrounds the base portion 14 and the rear segment 152 of the tongue plate 15 of the insulating housing 1. The outer grounding unit 5 in the instant embodiment includes a first grounding sheet 51 and a second grounding sheet 52, and the first grounding sheet 51 cannot be independently assembled (e.g., engaged) with the second grounding sheet 52. The construction of the first grounding sheet 51 in the instant embodiment is substantially equal to the construction of the second grounding sheet 52, but is not limited thereto. For example, the construction of the first grounding sheet 51 can be different from the construction of the second grounding sheet 52.

Figure 6E:
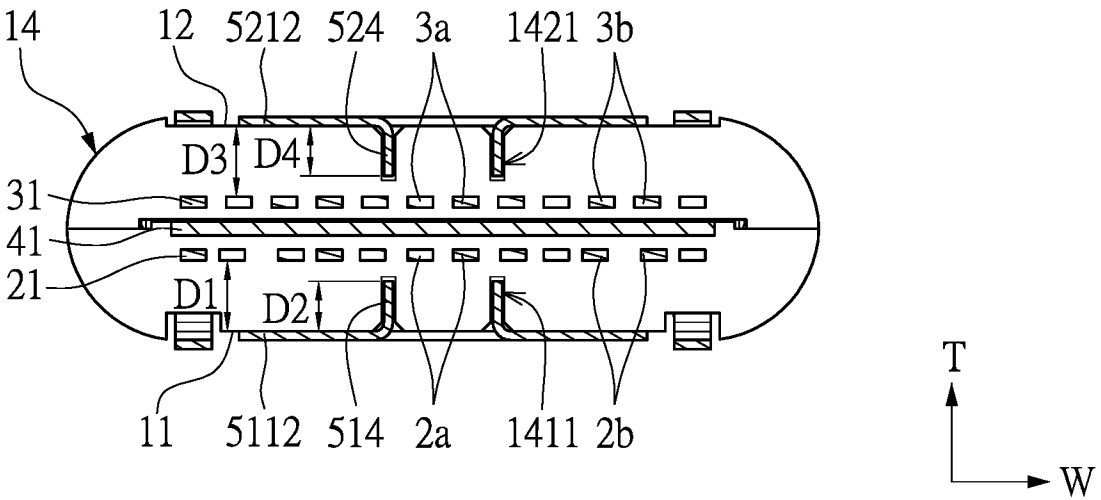
FIG. 6E is a cross-sectional view of FIG. 6A along a cross-sectional line VIE-VIE.

As shown in FIG. 2B, the first grounding sheet 51 includes a first sheet portion 511, two engaging portions 512, two elastic arms 513, and two first transverse shielding sheets 514. The engaging portions 512, the elastic arms 513, and the first transverse shielding sheets 514 in the instant embodiment are integrally extended from the first sheet portion 511. As shown in FIG. 5A, the first sheet portion 511 has a first covering portion 5111 and a first shielding portion 5112. The first covering portion 5111 having an elongated shape is disposed on the first surface 11 of the rear segment 152 of the tongue plate 15. The first shielding portion 5112 is curvedly extended from a long edge of the first covering portion 5111 and is disposed on the first surface 11 of the base portion 14, and parts of the first shielding portion 5112 disposed on the first surface 11 of the base portion 14 are respectively located at two opposite sides of the first slots 1411. Moreover, as shown in FIG. 6E, a first distance D1 in the height direction T is defined between the parts/portion of the first shielding portion 5112 disposed on the first surface 11 of the base portion 14 and the first extending segment 21 of the adjacent first conductive terminal 2.

Figure 2C:
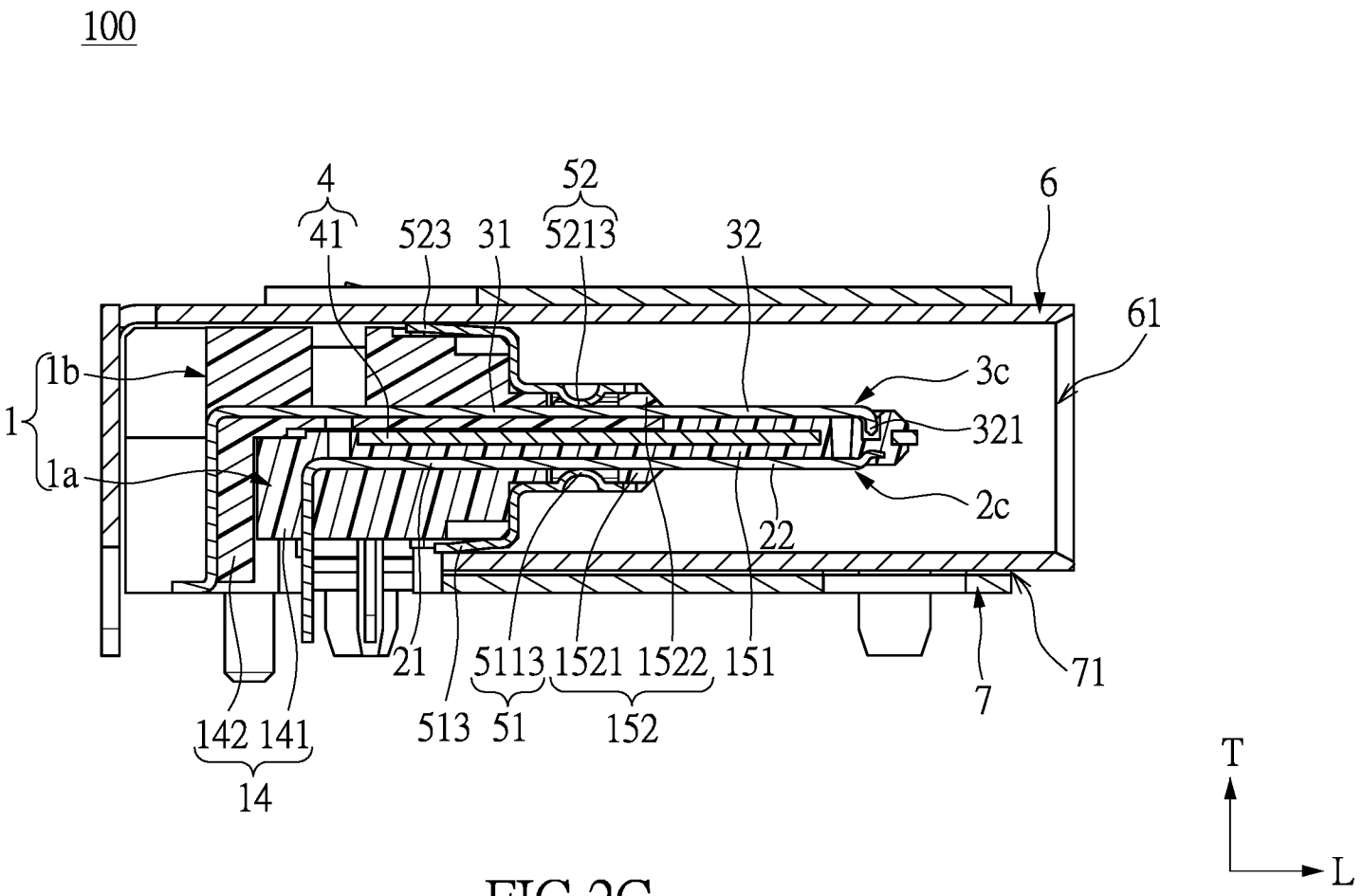
FIG. 2C is a cross-sectional view of FIG. 2A along a cross-sectional line IIC-IIC.

Specifically, as shown in FIGS. 2B and 2C, the first sheet portion 511 has two connecting portions 5113 concavely formed on the first covering portion 5111, and the two connecting portions 5113 are arranged in the rear segment 152 of the tongue plate 15 and respectively abut against the first extending segments 21 of the two first grounding terminals 2*c*. Each connecting portion 5113 in the instant embodiment is a bump formed by inwardly punching the first covering portion 5111, and each connecting portion 5113 is configured to abut against the corresponding first grounding terminal 2*c* for grounding with each other, but the construction or number of each connecting portion 5113 is not limited thereto.

As shown in FIG. 2B, the two engaging portions 512 are respectively and perpendicularly extended from two short edges of the first covering portion 5111, and each engaging portion 512 has a thru-hole 5121 approximately arranged on the center thereof. The two engaging portions 512 are respectively arranged in the two accommodating slots 1523 (FIG. 4) of the rear segment 152 of the tongue plate 15, and the two protruding sheets 42 of the inner grounding unit 4 are respectively inserted into the two thru-holes 5121 of the two engaging portions 512 (as shown in FIGS. 6C and 6D).

As shown in FIGS. 2B and 5A, the two elastic arms 513 are respectively and slantingly extended from two opposite ends of the long edge of the first covering portion 5111, and the two elastic arms 513 are respectively arranged at two opposite sides of the first shielding portion 5112. A gap is formed between a free end of each elastic arm 513 and the first surface 11 of the base portion 14, so the free end of each elastic arm 513 can be pressed to resiliently swing toward the first surface 11 of the base portion 14.

As shown in FIGS. 2B and 6E, the two first transverse shielding sheets 514 in the instant embodiment are respectively and perpendicularly extended from two edges of the first shielding portion 5112, which are disposed on the first surface 11 of the base portion 14 and facing to each other. That is to say, each first transverse shielding sheet 514 is in an electrical and structural connection with the first sheet portion 511. The two first transverse shielding sheets 514 are respectively inserted into and interference fitted with the two first slots 1411 of the base portion 14 (e.g., each first transverse shielding sheet 514 has at least one barb to thrust into the corresponding first slot 1411).

For a relative position of the first transverse shielding sheets 514 and the first conductive terminals 2 as shown in FIG. 6E, the two first transverse shielding sheets 514 are arranged between two regions defined by virtually extending the first extending segments 21 of the two pairs of first outside signal terminals 2*b* in the height direction T, and the two first transverse shielding sheets 514 are respectively arranged at two opposite sides of a region defined by virtually extending the first extending segments 21 of the pair of first inside signal terminals 2*a* in the height direction T. In the instant embodiment, the two first transverse shielding sheets 514 are arranged closer to the first extending segments 21 of the pair of first inside signal terminals 2*a* than the first extending segments 21 of the two pairs of first outside signal terminals 2*b*.

Accordingly, a space surrounded by the plate 41 of the inner grounding unit 4 and the first shielding portion 5112 of the first grounding sheet 51 can be divided into three partitions by arranging the two first transverse shielding sheets 514, the middle partition receives the first extending segments 21 of the pair of first inside signal terminals 2*a*, and the two lateral partitions respectively receive the first extending segments 21 of the two pairs of first outside signal terminals 2*b*, such that the first extending segments 21 of the pair of first inside signal terminals 2*a* can be shielded in the width direction W with respect to the first extending segments 21 of the two pairs of first outside signal terminals 2*b* by arranging the two first transverse shielding sheets 514, thereby reducing crosstalk of differential signaling.

Specifically, a length and a width of each first transverse shielding sheet 514 can be provided with the following limitations for having a better electromagnetic shielding effect. A second distance D2 in the height direction T is defined between one end of the first transverse shielding sheet 514 adjacent to the plate 41 of the inner grounding unit 4 (i.e., the free end of the first transverse shielding sheet 514 as shown in FIG. 6E) and the first shielding portion 5112 of the first sheet portion 511. The second distance D2 is greater than or equal to ⅓ of the first distance D1. Preferably, the second distance D2 is less than the first distance D1 and greater than or equal to ⅔ of the first distance D1 (i.e., $\frac{2}{3}D1 \leq D2 < D1$), and the second distance D2 in the instant embodiment is approximately ¾ of the first distance D1. It should be noted that if the second distance D2 is greater than the first distance D1, the first transverse shielding sheet 514 will pass through two adjacent first extending segments 21, so the first transverse shielding sheet 514 easily touches the first extending segments 21 to cause that the corresponding first conductive terminals 2 cannot be operated. Thus, the second distance D2 is preferably less than the first distance D1.

Moreover, in the longitudinal direction L as shown in FIG. 1B, the width $W_{514}$ of each first transverse shielding sheet 514 is greater than ⅓ of a width $W_{5112}$ of the first shielding portion 5112 and less than ⅔ of the width $W_{5112}$ of the first shielding portion 5112. The width $W_{514}$ in the instant embodiment is approximately ½ of the width $W_{5112}$.

In addition, each first transverse shielding sheet 514 in the instant embodiment is integrally connected to the first sheet portion 511, but is not limited thereto. For example (not shown), each first transverse shielding sheet can be an individual component and can be not extended from the first sheet portion, and when each first transverse shielding sheet is inserted into the corresponding first slot of the base portion, each first transverse shielding sheet must be electrically connected to the first sheet portion.

The first grounding sheet 51 is provided with the two first transverse shielding sheets 514, but the number of first transverse shielding sheets 514 of the first grounding sheet 51 can be changed according to different demands. For example, the first grounding sheet 51 can be provided with only one first transverse shielding sheet 514.

As shown in FIG. 1B, the second grounding sheet 52 includes a second sheet portion 521, two engaging portions 522, two elastic arms 523, and two second transverse shielding sheets 524. The engaging portions 522, the elastic arms 523, and the second transverse shielding sheets 524 in the instant embodiment are integrally extended from the second sheet portion 521. As shown in FIG. 6A, the second sheet portion 521 has a second covering portion 5211 and a second shielding portion 5212. The second covering portion 5211 having an elongated shape is disposed on the second surface 12 of the rear segment 152 of the tongue plate 15. The second shielding portion 5212 is curvedly extended from a long edge of the second covering portion 5211 and is disposed on the second surface 12 of the base portion 14, and parts of the second shielding portion 5212 disposed on the second surface 12 of the base portion 14 are respectively located at two opposite sides of the second slots 1421. Moreover, as shown in FIG. 6E, a third distance D3 in the height direction T is defined between the parts of the second shielding portion 5212 disposed on the second surface 12 of the base portion 14 and the second extending segment 31 of the adjacent second conductive terminal 3.

Specifically, as shown in FIGS. 1B and 2C, the second sheet portion 521 has two connecting portions 5213 concavely formed on the second covering portion 5211, and the two connecting portions 5213 are arranged in the rear segment 152 of the tongue plate 15 and respectively abut against the second extending segments 31 of the two second grounding terminals 3*c*. Each connecting portion 5213 in the instant embodiment is a bump formed by inwardly punching the second covering portion 5211, and each connecting portion 5213 is configured to abut against the corresponding second grounding terminal 3*c* for grounding with each other, but the construction or number of each connecting portion 5213 is not limited thereto.

As shown in FIG. 1B, the two engaging portions 522 are respectively and perpendicularly extended from two short edges of the second covering portion 5211, and each engaging portion 522 has a thru-hole 5221 approximately arranged on the center thereof. The two engaging portions 522 are respectively arranged in the two accommodating slots 1523 (FIG. 4) of the rear segment 152 of the tongue plate 15, and the two protruding sheets 42 of the inner grounding unit 4 are respectively inserted into the two thru-holes 5221 of the two engaging portions 522 (as shown in FIGS. 6C and 6D). Specifically, the two engaging portions 522 of the second grounding sheet 52 are respectively stacked on the two engaging portions 512 of the first grounding sheet 51 so as to construct two sets of stacked engaging portions 512, 522. The two protruding sheets 42 are respectively inserted into the thru-holes 5121, 5221 of the two sets of stacked engaging portions 512, 522.

As shown in FIGS. 1B and 6A, the two elastic arms 523 are respectively and slantingly extended from two opposite ends of the long edge of the second covering portion 5211, and the two elastic arms 523 are respectively arranged at two opposite sides of the second shielding portion 5212. A gap is formed between a free end of each elastic arm 523 and the second surface 12 of the base portion 14, so the free end of each elastic arm 523 can be pressed to resiliently swing toward the second surface 12 of the base portion 14.

As shown in FIGS. 1B and 6E, the two second transverse shielding sheets 524 in the instant embodiment are respectively and perpendicularly extended from two edges of the second shielding portion 5212, which are disposed on the second surface 12 of the base portion 14 and facing to each other. That is to say, each second transverse shielding sheet 524 is in an electrical and structural connection with the second sheet portion 521. The two second transverse shielding sheets 524 are respectively inserted into and interference fitted with the two second slots 1421 of the base portion 14 (e.g., each second transverse shielding sheet 524 has at least one barb to thrust into the corresponding second slot 1421).

For a relative position of the second transverse shielding sheets 524 and the second conductive terminals 3 as shown in FIG. 6E, the two second transverse shielding sheets 524 are arranged between two regions defined by virtually extending the second extending segments 31 of the two pairs of second outside signal terminals 3*b* in the height direction T, and the two second transverse shielding sheets 524 are respectively arranged at two opposite sides of a region defined by virtually extending the second extending segments 31 of the pair of second inside signal terminals 3*a* in the height direction T. In the instant embodiment, the two second transverse shielding sheets 524 are arranged closer to the second extending segments 31 of the pair of second inside signal terminals 3*a* than the second extending segments 31 of the two pairs of second outside signal terminals 3*b*. Moreover, in the instant embodiment, the two second transverse shielding sheets 524 are respectively coplanar with the two first transverse shielding sheets 514 in the height direction T, but are not limited thereto.

Accordingly, a space surrounded by the plate 41 of the inner grounding unit 4 and the second shielding portion 5212 of the second grounding sheet 52 can be divided into three partitions by arranging the two second transverse shielding sheets 524. The middle partition receives the second extending segments 31 of the pair of second inside signal terminals 3*a*, and the two lateral partitions respectively receive the second extending segments 31 of the two pairs of second outside signal terminals 3*b*, such that the second extending segments 31 of the pair of second inside signal terminals 3*a* can be shielded in the width direction W with respect to the second extending segments 31 of the two pairs of second outside signal terminals 3*b* by arranging the two second transverse shielding sheets 524, thereby reducing crosstalk of differential signaling.

Specifically, a length and a width of each second transverse shielding sheet 524 can be provided with the following limitations for having a better electromagnetic shielding effect. A fourth distance D4 in the height direction T is defined between one end of the second transverse shielding sheet 524 adjacent to the plate 41 of the inner grounding unit 4 (i.e., the free end of the second transverse shielding sheet 524 as shown in FIG. 6E) and the second shielding portion 5212 of the second sheet portion 521. The fourth distance D4 is greater than or equal to ⅓ of the third distance D3. Preferably, the fourth distance D4 is less than the third distance D3 and greater than or equal to ⅔ of the third distance D3 (i.e., $\frac{2}{3}D3 \leq D4 < D3$), and the fourth distance D4 in the instant embodiment is approximately ¾ of the third distance D3. It should be noted that if the fourth distance D4 is greater than the third distance D3, the second transverse shielding sheet 524 will pass through two adjacent second extending segments 31, so the second transverse shielding sheet 524 easily touches the second extending segments 31 to cause that the corresponding second conductive terminals 3 cannot be operated. Thus, the fourth distance D4 is preferably less than the third distance D3.

Moreover, in the longitudinal direction L as shown in FIG. 1B, the width $W_{524}$ of each second transverse shielding sheet 524 is greater than ⅓ of a width $W_{5212}$ of the second shielding portion 5212 and less than ⅔ of the width $W_{5212}$ of the second shielding portion 5212. The width $W_{524}$ in the instant embodiment is approximately ½ of the width $W_{5212}$.

In addition, each second transverse shielding sheet 524 in the instant embodiment is integrally connected to the second sheet portion 521, but is not limited thereto. For example (not shown), each second transverse shielding sheet can be an individual component and can be not extended from the second sheet portion, and when each second transverse shielding sheet is inserted into the corresponding second slot of the base portion, each second transverse shielding sheet must be electrically connected to the second sheet portion.

The second grounding sheet 52 is provided with the two second transverse shielding sheets 524, but the number of second transverse shielding sheets 524 of the second grounding sheet 52 can be changed according to different demands. For example, the second grounding sheet 52 can be provided with only one second transverse shielding sheet 524.

Accordingly, in order to clearly know the effect generated from the first and second transverse shielding sheets 514, 524, a simulation is implemented by taking the electrical connector 100 of the instant embodiment to be a treatment group and taking an electrical connector (not shown), which is provided without any first and second transverse shielding sheets 514, 524, to be a control group. Specifically, the simulation is implemented by inputting a detecting signal into one of the first inside signal terminals 2*a* and measuring the first outside signal terminals 2*b*, therefore understanding the noise on the first outside signal terminals 2*b*, arising from the signal transmission of the first inside signal terminals 2*a*; or the simulation is implemented by inputting a detecting signal into one of the second inside signal terminals 3*a* and measuring the second outside signal terminals 3*b*, therefore understanding the noise on the second outside signal terminals 3*b* arising from the signal transmission of the second inside signal terminals 3*a*.

Figure 11:
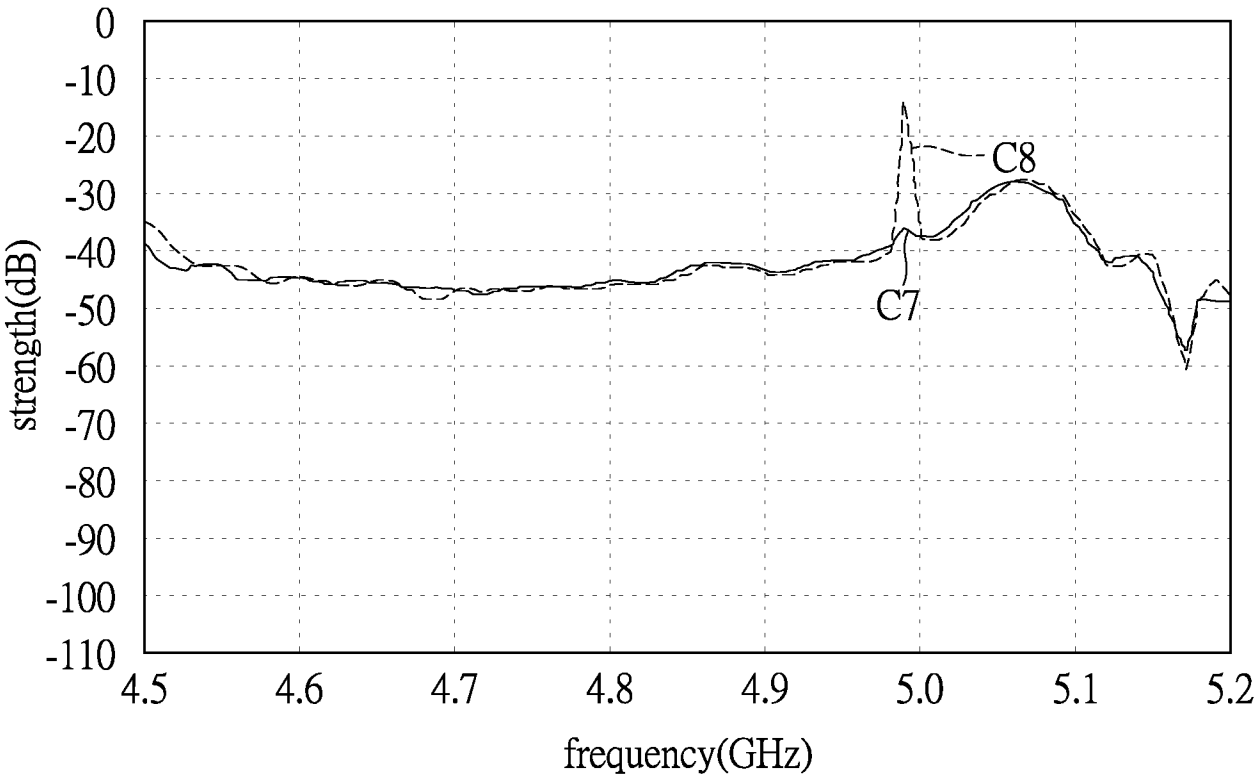
FIG. 11 is a fourth diagram showing a simulation result, which is generated by taking the electrical connector of the instant disclosure as a treatment group and taking a corresponding connector as a control group.

The simulation result is shown as FIG. 11. The curve C7 presents the simulation result of the electrical connector 100 of the instant embodiment, and the curve C8 presents the simulation result of the electrical connector, which is the control group. Accordingly, the electrical connector 100 of the instant embodiment can be used to reduce crosstalk of differential signaling in the width direction W, by forming the first and second transverse shielding sheets 514, 524.

In addition, the outer grounding unit 5 in the instant embodiment consists of two pieces (i.e., the first grounding sheet 51 and the second grounding sheet 52), but the first grounding sheet 51 and the second grounding sheet 52 of the outer grounding unit 5 can be formed in one piece construction. For example (not shown), the outer grounding unit can be a ring construction formed by bending an elongated metal strip and connecting two opposite ends of the elongated metal strip, so that one set of the stacked engaging portions of the first and second grounding sheets are integrally formed in one piece with only one thru-hole, thus the outer grounding unit surrounds the rear segment of the tongue plate and engages the two protruding sheets, and one of the two protruding sheets is inserted into the thru-holes of the other set of the stacked engaging portions. Furthermore, for each set of the stacked engaging portions, the inner engaging portion (i.e., the engaging portion of the first grounding sheet) is provided without any thru-hole and is abutted against the corresponding protruding sheet in the height direction, that is to say, the inner engaging portion is not engaged with the corresponding protruding sheet; the outer engaging portion (i.e., the engaging portion of the second grounding sheet) is provided with the thru-hole for engaging the corresponding protruding sheet, and the outer engaging portion abuts against the adjacent inner engaging portion.

Figure 7A:
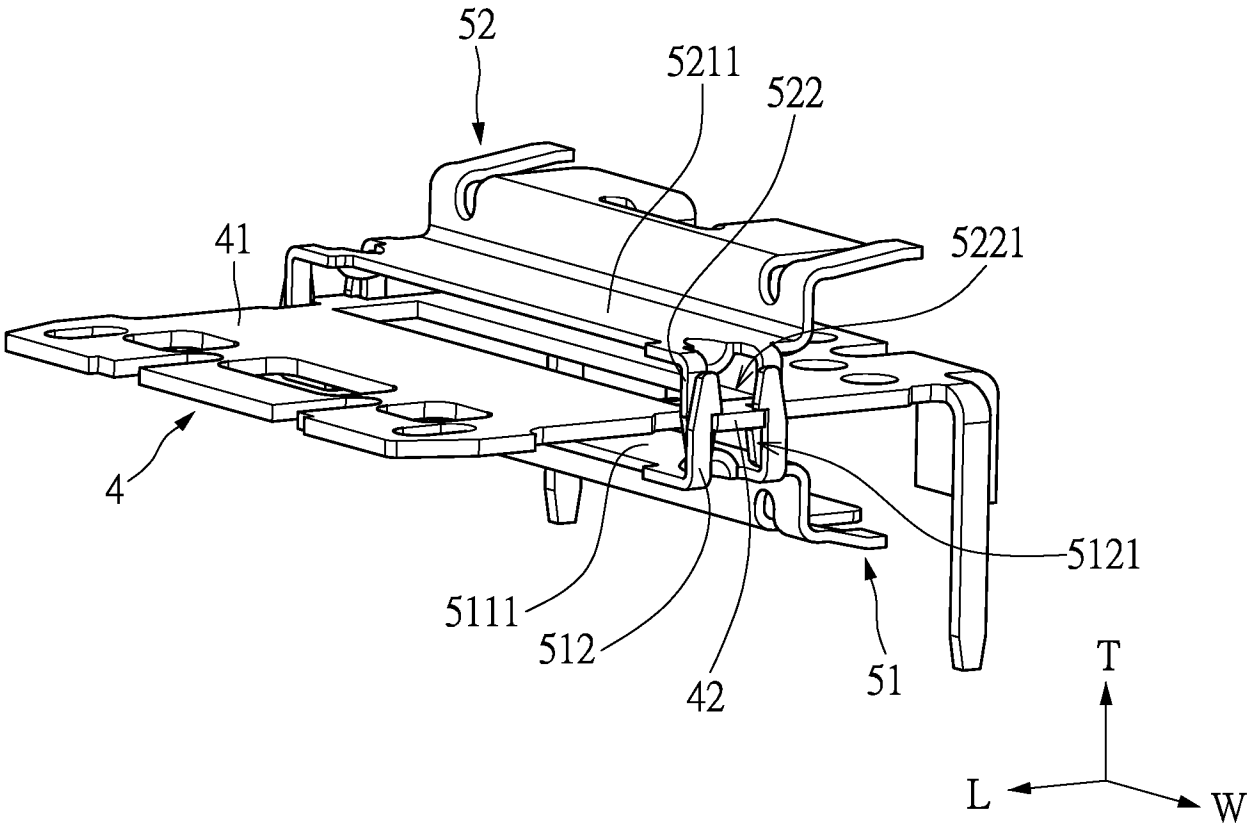
FIG. 7A is a perspective view showing the inner grounding unit and the outer grounding unit of the electrical connector according to a second embodiment of the instant disclosure.
Figure 7B:
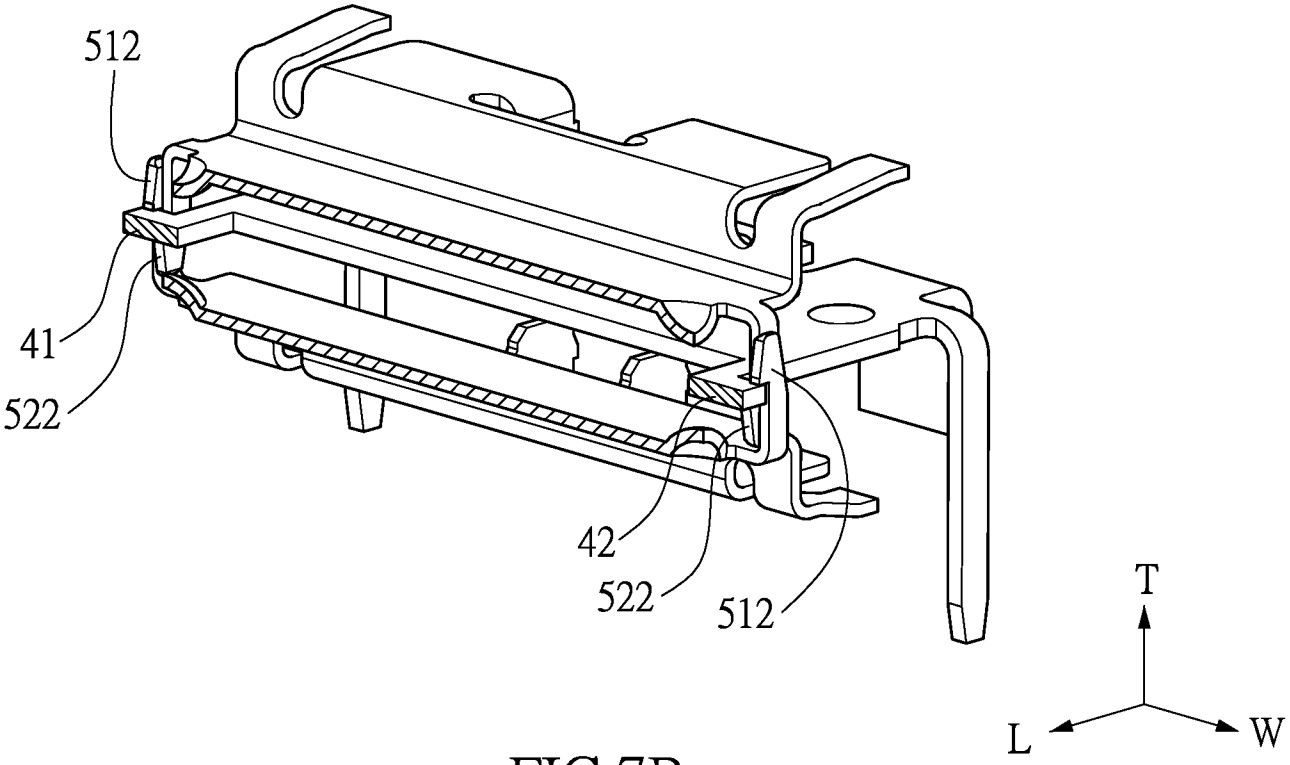
FIG. 7B is a cross-sectional view of FIG. 7A.
Figure 8:
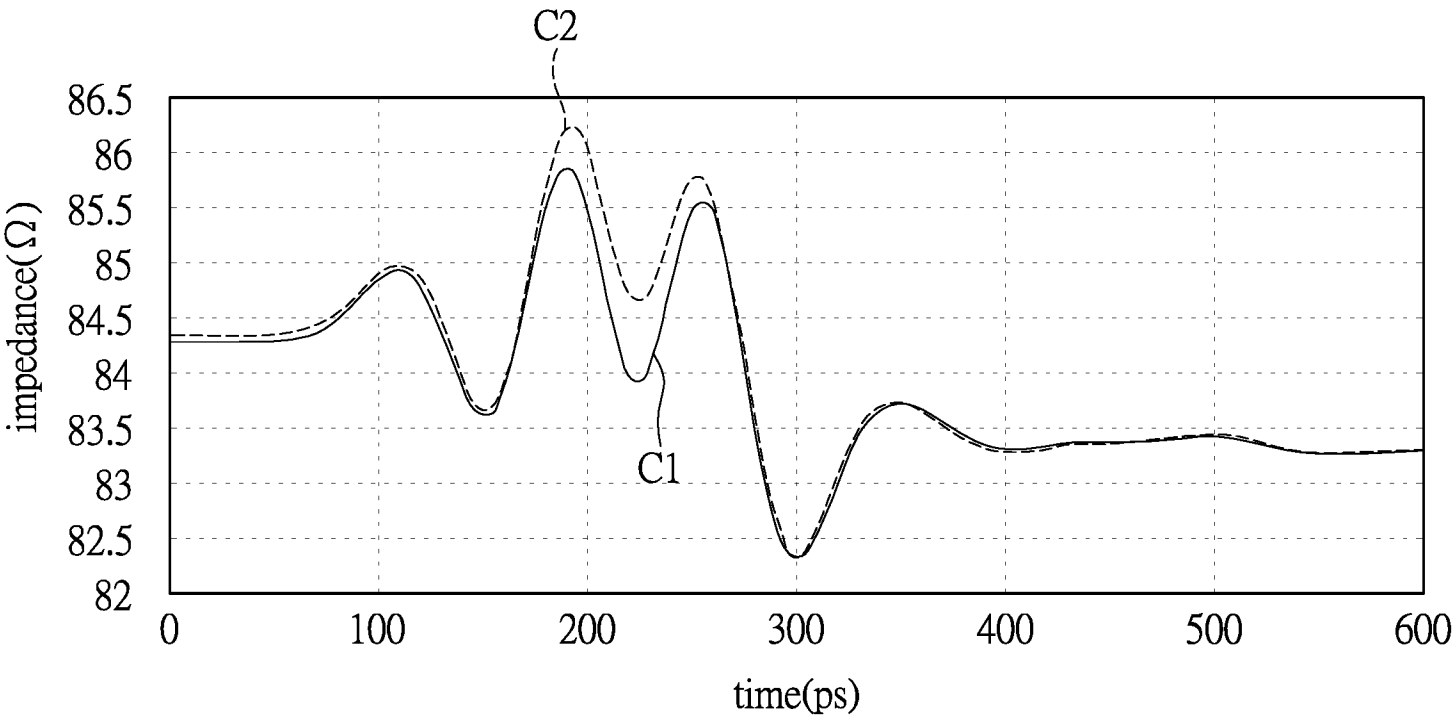
FIG. 8 is a first diagram showing a simulation result, which is generated by taking the electrical connector of the instant disclosure as a treatment group and taking a corresponding connector as a control group.
Figure 9:
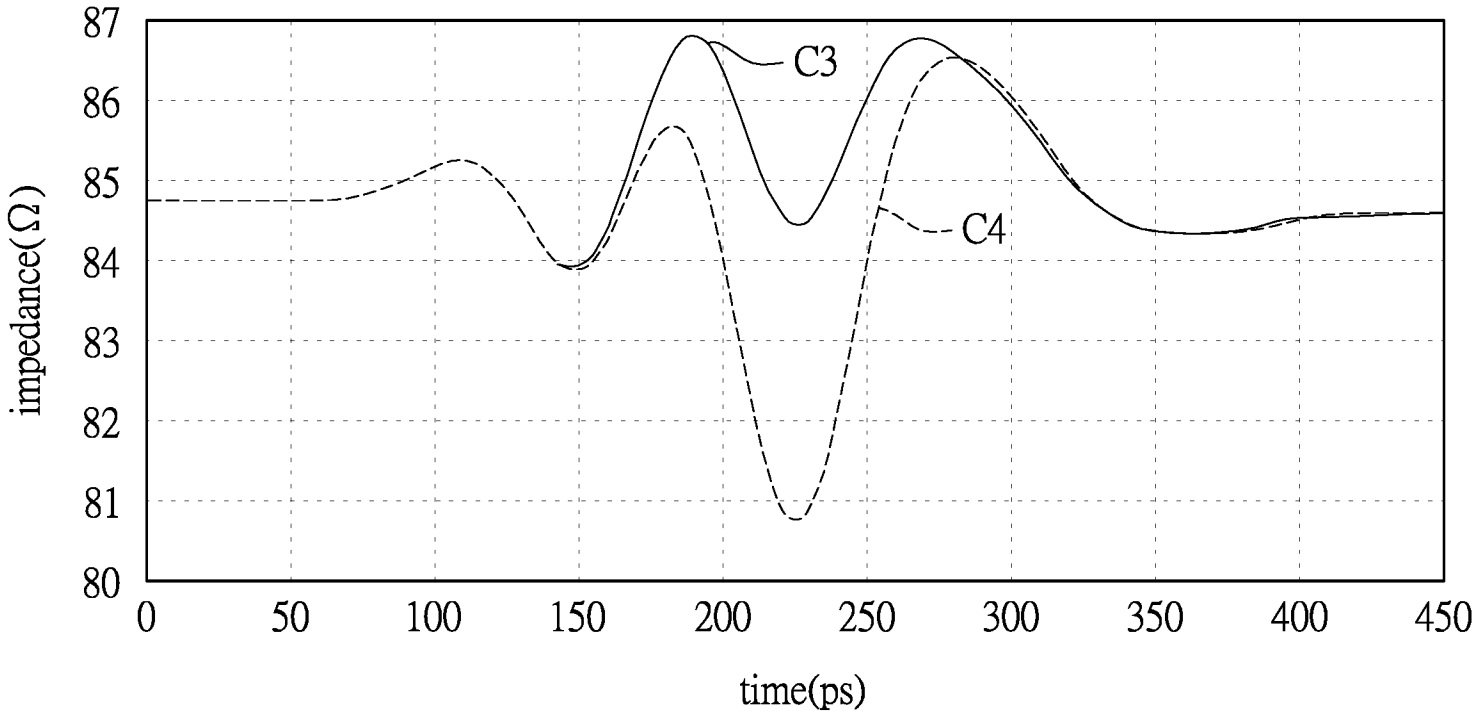
FIG. 9 is a second diagram showing a simulation result, which is generated by taking the electrical connector of the instant disclosure as a treatment group and taking a corresponding connector as a control group.

Moreover, as shown the FIGS. 1B and 2B, each protruding sheet 42 is a folded double-layer construction and each engaging portion 512, 522 is a ring-shaped sheet, but the instant disclosure is not limited thereto. For example, as shown in FIGS. 7A and 7B, each protruding sheet 42 is a single layer construction integrally extended from the plate 41, each engaging portion 512 has a pair of hooks integrally and perpendicularly extended from the corresponding short edge of the first covering portion 5111, and each engaging portion 522 has a pair of hooks integrally and perpendicularly extended from the corresponding short edge of the second covering portion 5211. An inner edge of the pair of hooks of each engaging portion 512, 522 surroundingly defines the corresponding thru-hole 5121, 5221.

Specifically, the two protruding sheets 42 of the inner grounding unit 4 are respectively inserted into the thru-holes 5121, 5221 of the two sets of stacked engaging portions 512, 522 each having a hook-shape. In other words, each engaging portion 512 of the first grounding sheet 51 buckles on a surface of the corresponding protruding sheet 42 (i.e., the top surface of the protruding sheet 42 as shown in FIG. 7B), and each engaging portion 522 of the second grounding sheet 52 buckles on an opposite surface of the corresponding protruding sheet 42 (i.e., the bottom surface of the protruding sheet 42 as shown in FIG. 7B).

As shown in FIG. 2C, the relationship between the first and second bodies 1*a*, 1*b* of the insulating housing 1 and the other components is disclosed in the following description. The first extending segments 21 and the first engaging segments 22 of the first conductive terminals 2 and the plate 41 of the inner grounding unit 4 are embedded in the first body 1*a*. The second extending segments 31 of the second conductive terminals 3 are embedded in the second body 1*b*, and the second engaging segments 32 protrude from the second rear segment 1522 of the second body 1*b*.

When the first body 1*a* is combined with the second body 1*b*, two fixing arms (not labeled) of the second body 1*b* respectively arranged on two opposite sides of the second base portion 142 buckle on the first base portion 141 of the first body 1*a*, thereby fixing the first and second bodies 1*a*, 1*b* to construct the insulating housing 1. The second engaging segments 32 of the second conductive terminals 3 are respectively arranged in a plurality of grooves concavely formed on the second surface 12 of the front segment 151 of the first body 1*a*, and the second free end portions 321 of the second engaging segments 32 are interference fitted with the front segment 151. The first and second grounding sheets 51, 52 of the outer grounding unit 5 clip the first and second bodies 1*a*, 1*b*, thereby maintaining the relative position of the first and second bodies 1*a*, 1*b*. Moreover, the above construction is provided for quickly assembling the electrical connector 100 and easily positioning the components of the electrical connector 100.

As shown in FIGS. 2A through 2C, the first metallic shell 6 has an inserting opening 61 formed on one end thereof, and the first metallic shell 6 has a first buckling portion 62 formed on a portion thereof away from the inserting opening 61. The insulating housing 1 is inserted into the first metallic shell 6, and the tongue plate 15 can be coupled with a mating connector in the longitudinal direction L via the inserting opening 61. Each elastic arm 513, 523 of the outer grounding unit 5 is pressed on and abutted against an inner surface of the first metallic shell 6 for establishing an electrical connection among the outer grounding unit 5, the inner grounding unit 4, the first and second grounding terminals 2*c*, 3*c*, and the first metallic shell 6, such that the high frequency effect of the electrical connector 100 can be improved by electrically connecting all of the grounding components of the electrical connector 100 to maintain the ground path.

The second metallic shell 7 has an opening 71 formed on one end thereof, and the second metallic shell 7 has a second buckling portion 72 formed on a portion thereof away from the opening 71. The first metallic shell 6 is inserted into the second metallic shell 7, and the front end of the first metallic shell 6 having the inserting opening 61 protrudes from the opening 71 of the second metallic shell 7. Moreover, the first buckling portion 62 is buckled on the second buckling portion 72, thereby maintaining the relative position between the first metallic shell 6 and the second metallic shell 7.

In the instant embodiment, the first buckling portion 62 is a slanting sheet, and the second buckling portion 72 is a hole for receiving the slanting sheet, but the instant disclosure is not limited thereto. That is to say, the constructions of the first and second buckling portions 62, 72 can be changed if the first and second buckling portions 62, 72 can be buckled on each other to maintain the relative position there-between.

[The Possible Effect of the Instant Disclosure]

In summary, the electrical connector of the instant disclosure is provided to load a larger insertion force by engaging the outer grounding unit (i.e., the first and second grounding sheets) with the inner grounding unit, and the outer grounding unit is electrically connected to the inner grounding unit for increasing the high frequency effect of the electrical connector. The outer grounding unit is electrically connected to the first and second grounding terminals by forming the connecting portions and is electrically connected to the first metallic shell by forming the elastic arms, such that the high frequency effect of the electrical connector can be improved by electrically connecting all of the grounding components of the electrical connector to maintain the ground path.

Moreover, the space surrounded by the plate of the inner grounding unit and the first shielding portion of the first grounding sheet is divided into three partitions by arranging the two first transverse shielding sheets, such that the first extending segments of the pair of first inside signal terminals can be shielded in the width direction with respect to the first extending segments of the two pairs of first outside signal terminals by arranging the two first transverse shielding sheets, thereby reducing crosstalk of differential signaling. Similarly, the space surrounded by the plate of the inner grounding unit and the second shielding portion of the second grounding sheet is divided into three partitions by arranging the two second transverse shielding sheets, such that the second extending segments of the pair of second inside signal terminals can be shielded in the width direction with respect to the second extending segments of the two pairs of second outside signal terminals by arranging the two second transverse shielding sheets, thereby reducing crosstalk of differential signaling.

Furthermore, in the longitudinal direction, each of the longitudinal shielding sheets is approximately arranged between the second connecting segments of the adjacent pair of second outside signal terminals and the first connecting segments of the adjacent pair of first outside signal terminals, thus the two longitudinal shielding sheets have an electromagnetic shielding effect occurring between each pair of second outside signal terminals and the adjacent pair of first outside signal terminals, thereby reducing crosstalk of differential signaling.

In addition, the insulating housing has the first body and the second body detachably combined with the first body, the first extending segments and the first engaging segments of the first conductive terminals and the plate of the inner grounding unit are embedded in the first body, and the second extending segments of the second conductive terminals are embedded in the second body, thereby quickly assembling the electrical connector and easily positioning the components. The first and second grounding sheets of the outer grounding unit clip the first and second bodies, thereby maintaining the relative position of the first and second bodies.

The descriptions illustrated supra set forth simply the preferred embodiments of the instant invention; however, the characteristics of the instant invention are by no means restricted thereto. All changes, alterations, or modifications conveniently considered by those skilled in the art are deemed to be encompassed within the scope of the instant invention delineated by the following claims.

What is claimed is:

1. An electrical connector with two insertion orientations, comprising:

an insulating housing having a base portion and a tongue plate extended from the base portion;

a plurality of first conductive terminals and a plurality of second conductive terminals disposed in the insulating housing, wherein each first conductive terminal faces toward a part of one of the second conductive terminals in a height direction;

an inner grounding unit having a plate embedded in the insulating housing and two protruding sheets respectively extended from two opposite edges of the plate and protruding from the insulating housing, wherein each of the two protruding sheets is a single layer structure, and wherein in the height direction, the plate is arranged to separate each first conductive terminal from the faced part of the second conductive terminal; and an outer grounding unit fastening to a part of the tongue plate adjacent to the base portion and engaged with the two protruding sheets, wherein a part of the outer grounding unit engaged with one of the two protruding sheets has two engaging portions, each of the two engaging portions has a pair of hooks, and at least one of the two engaging portions detachably buckles to the corresponding protruding sheet.

2. The electrical connector as claimed in claim 1, wherein the outer grounding unit has a first grounding sheet and a second grounding sheet, the two engaging portions are respectively arranged on one end portion of the first grounding sheet and one end portion of the second grounding sheet, and the two engaging portions buckle to the corresponding protruding sheet.

3. The electrical connector as claimed in claim 2, wherein the engaging portion of the first grounding sheet buckles onto a surface of the corresponding protruding sheet, and the engaging portion of the second grounding sheet buckles with an opposite surface of the corresponding protruding sheet.

4. The electrical connector as claimed in claim 1, wherein the first conductive terminals have two first grounding terminals, the second conductive terminals have two second grounding terminals, the outer grounding unit has at least one connecting portion, and the at least one connecting portion is connected to at least one of the first and second grounding terminals.

5. The electrical connector as claimed in claim 1, further comprising a first metallic shell, wherein the insulating housing is inserted into the first metallic shell, the outer grounding unit has at least one elastic arm, and the at least one elastic arm is pressed on and abutted against an inner surface of the first metallic shell.

6. The electrical connector as claimed in claim 5, further comprising a second metallic shell, wherein the first metallic shell is inserted into the second metallic shell, the first metallic shell has a first buckling portion, the second metallic shell has a second buckling portion, and the first and second buckling portions are engaged with each other.

7. The electrical connector as claimed in claim 1, wherein an outer surface of the insulating housing has a first surface and an opposite second surface, the first conductive terminals have a pair of first inside signal terminals and two pairs of first outside signal terminals, a plurality of portions of the two pairs of first outside signal terminals aligning with the plate are respectively arranged at two opposite sides of two portions of the pair of first inside signal terminals aligning with the plate; wherein the outer grounding unit comprises:

a first sheet portion and a second sheet portion respectively covering the first surface and the second surface both of the base portion and part of the tongue plate adjacent to the base portion; and at least one first transverse shielding sheet mounted on the base portion and electrically connected to the first sheet portion, wherein the at least one first transverse shielding sheet is arranged between two regions defined by virtually extending the portions of the two pairs of first outside signal terminals aligning with the plate in the height direction, and the at least one first transverse shielding sheet is arranged at one of two opposite sides of a region defined by virtually extending the two portions of the pair of first inside signal terminals aligning with the plate in the height direction.

8. The electrical connector as claimed in claim 7, wherein a first distance in the height direction is defined between a portion of the first sheet portion disposed on the first surface of the base portion and a portion of the adjacent first conductive terminal aligning with the plate, the number of first transverse shielding sheets of the outer grounding unit is two, the two first transverse shielding sheets are mounted on the base portion and electrically connected to the first sheet portion; the two first transverse shielding sheets are arranged between the two regions defined by virtually extending the portions of the two pairs of first outside signal terminals aligning with the plate in the height direction, and the two first transverse shielding sheets are respectively arranged at two opposite sides of the region defined by virtually extending the two portions of the pair of first inside signal terminals aligning with the plate in the height direction; a second distance in the height direction is defined between one end of each first transverse shielding sheet adjacent to the plate and the first sheet portion, and the second distance is greater than or equal to ⅓ of the first distance.

9. The electrical connector as claimed in claim 8, wherein the second distance is less than the first distance and greater than or equal to ⅔ of the first distance.

10. The electrical connector as claimed in claim 9, wherein the base portion has two first slots formed on the first surface thereof in the height direction, the two first transverse shielding sheets are curvedly extended from the portion of the first sheet portion disposed on the first surface of the base portion, and the two first transverse shielding sheets are respectively inserted into the two first slots.

11. The electrical connector as claimed in claim 8, wherein the insulating housing defines an longitudinal direction, and the electrical connector is provided to detachably couple with a mating connector in the longitudinal direction, wherein in the longitudinal direction, a width of each first transverse shielding sheet is greater than ⅓ of a width of the portion of the first sheet portion disposed on the first surface of the base portion and less than ⅔ of the width of the portion of the first sheet portion disposed on the first surface of the base portion.

12. The electrical connector as claimed in claim 1, wherein the first conductive terminals have a pair of first inside signal terminals and two pairs of first outside signal terminals, a plurality of portions of the two pairs of first outside signal terminals aligning with the plate are respectively arranged at two opposite sides of two portions of the pair of first inside signal terminals aligning with the plate; the second conductive terminals have a pair of second inside signal terminals and two pairs of second outside signal terminals, a plurality of portions of the two pairs of second outside signal terminals aligning with the plate are respectively arranged at two opposite sides of two portions of the pair of second inside signal terminals aligning with the plate; each first conductive terminal has a first connecting segment extended from a portion thereof aligning with the plate, and each second conductive terminal has a second connecting segment extended from a portion thereof aligning with the plate; the first connecting segments are respectively arranged in a first row and a second row, the first connecting segments of the two pairs of first outside signal terminals are arranged in the first row; the second connecting segments are arranged in a third row, the second connecting segments of the two pairs of second outside signal terminals are respectively arranged close to the first connecting segments of the two pairs of first outside signal terminals; the inner grounding unit has at least one longitudinal shielding sheet curvedly extended from the plate, the at least one longitudinal shielding sheet is arranged between the first row and the third row, the at least one longitudinal shielding sheet has an electromagnetic shielding effect occurring between the second connecting segments of one pair of the two pairs of second outside signal terminals and the first connecting segments of the adjacent pair of first outside signal terminals; an outer surface of the insulating housing has a first surface, an opposite second surface, and two side surfaces arranged between the first and second surfaces, and a distance between the two side surfaces defines a width direction, wherein in the width direction, a width of the at least one longitudinal shielding sheet is greater than or equal to a smallest distance between two opposite outer edges of the second connecting segments of the adjacent pair of second outside signal terminals or a smallest distance between two opposite outer edges of the first connecting segments of the adjacent pair of first outside signal terminals.

13. The electrical connector as claimed in claim 12, wherein in the height direction, a distance between one end of the at least one longitudinal shielding sheet arranged away from the plate and a portion of each second conductive terminal aligning with the plate is less than or equal to a length of each second connecting segment.

14. The electrical connector as claimed in claim 13, wherein the first row, the second row, and the third row are substantially parallel with each other, the second row is arranged between the first row and the third row, the first connecting segments of the pair of first inside signal terminals are arranged in the second row, and the at least one longitudinal shielding sheet is arranged in the second row near one side of the first connecting segments of the pair of first inside signal terminals.

15. The electrical connector as claimed in claim 13, wherein the insulating housing has a first body and second body, the portion of each first conductive terminal aligning with the plate and the plate of the inner grounding unit is embedded in the first body, the portion of each second conductive terminal aligning with the plate is embedded in the second body, and the outer grounding unit fastens the first and second bodies.

16. The electrical connector as claimed in claim 13, wherein the portion of each first conductive terminal aligning with the plate has a first free end portion arranged away from the corresponding first connecting segment, the portion of each second conductive terminal aligning with the plate has a second free end portion arranged away from the corresponding second connecting segment; a plurality of openings are formed on the plate of the inner grounding unit, and the openings are respectively arranged between the first free end portions and the corresponding second free end portions, the second free end portions are respectively and partially arranged in the openings of the plate.

* * * * *